United States Patent [19]

Tega

[11] 4,311,003

[45] Jan. 19, 1982

[54] MACHINE FOR THE FORMATION OF CHAINS WITH LINKS OF TWO TYPES

[75] Inventor: Ezio Tega, Arezzo, Italy

[73] Assignee: Emmegizeta Metalmeccanica Gori & Zucchi M.G.Z. S.p.A., Arezzo, Italy

[21] Appl. No.: 122,255

[22] Filed: Feb. 19, 1980

[30] Foreign Application Priority Data

Mar. 16, 1979 [IT] Italy ..... 9368 A/79

[51] Int. Cl.[3] ..... B21L 11/00

[52] U.S. Cl. ..... 59/16; 59/25

[58] Field of Search ..... 59/1, 3, 10, 16, 18, 59/19, 22–25

[56] References Cited

U.S. PATENT DOCUMENTS 1,818,111 8/1931 Wirth et al. ..... 59/16

1,835,598 12/1931 Hogberg et al. ..... 59/3

3,961,474 6/1976 Esser ..... 59/23

4,127,987 12/1978 Tega ..... 59/25 X 4,175,379 11/1979 Tega ..... 59/16

*Primary Examiner*—Howard N. Goldberg

*Attorney, Agent, or Firm*—Hopgood, Calimafde, Kalil, Blaustein & Judlowe

[57] ABSTRACT

The invention contemplates a chain-making machine having the capability of making continuous chain wherein successive links follow a predetermined relative size and shape, with selective applicability to different input materials, including wire and/or flat ribbon, for the respective successive links. For each link-forming cycle, the production of one kind of link may call for one kind of motion in a manufactured-chain accumulating device, while production of another kind of link may call for a different kind of motion in the accumulating device, yet the machine includes provision for proper accommodation of these different motions, as each different link is formed, to the end that the resulting product will be free of entanglement.

8 Claims, 28 Drawing Figures

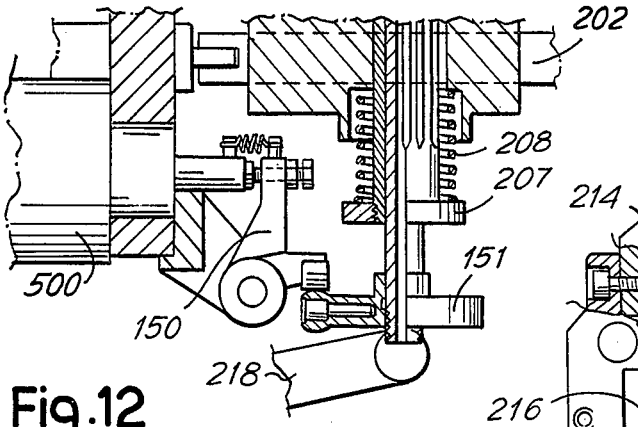
Fig.12
Fig.11
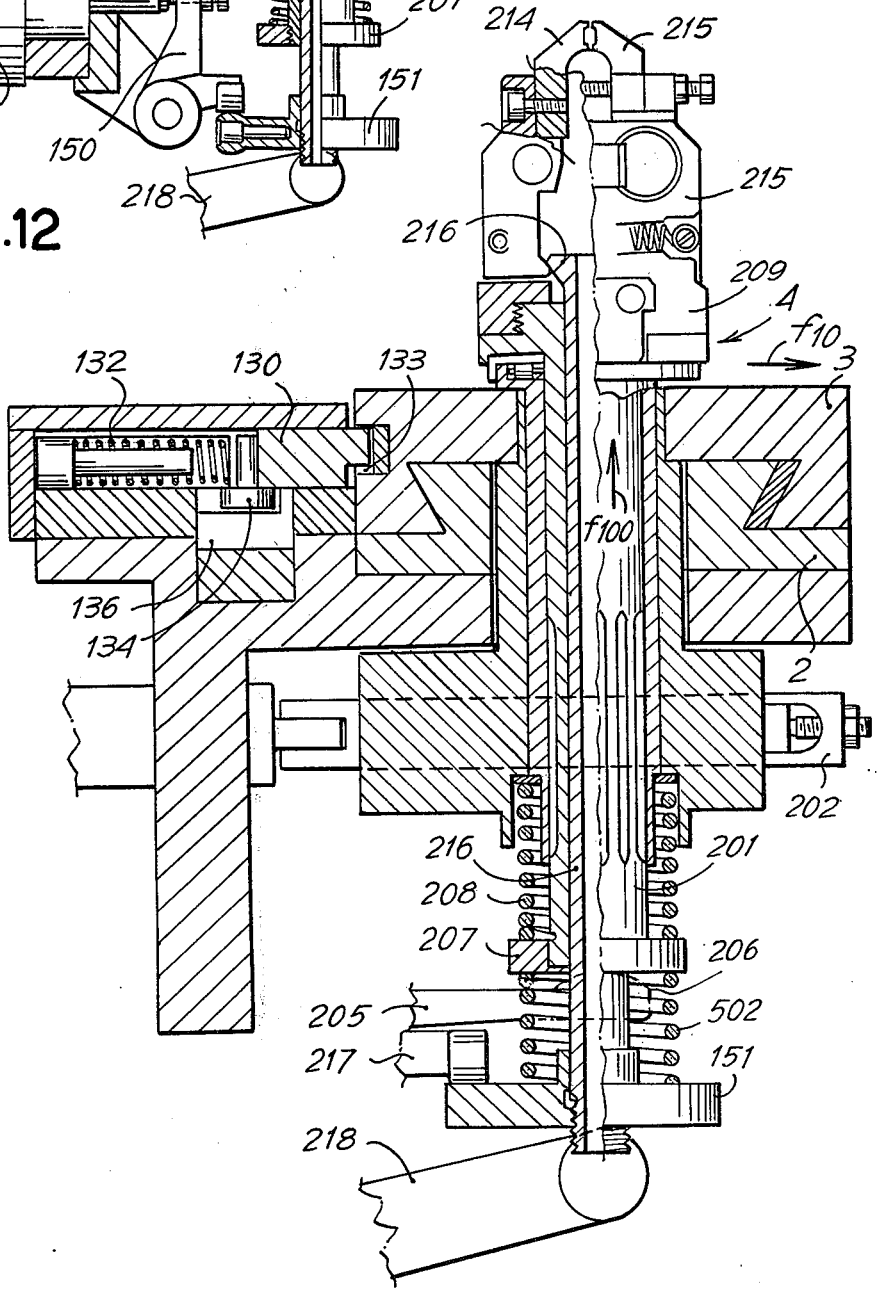

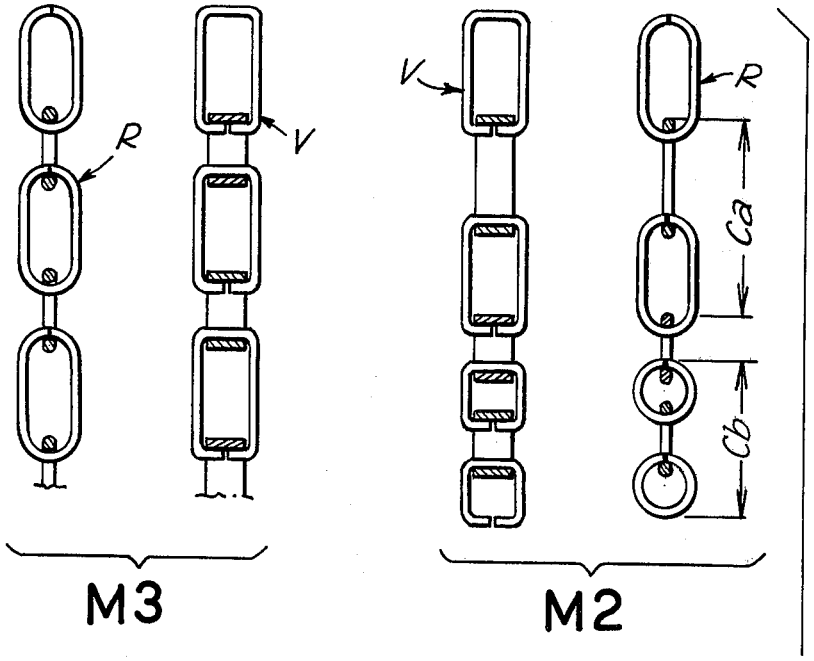
Fig. 20
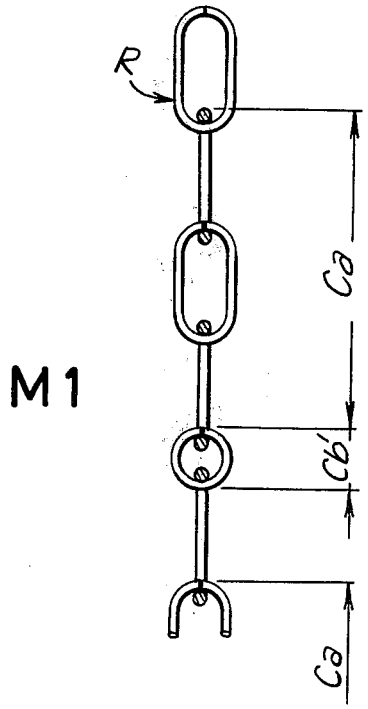

MACHINE FOR THE FORMATION OF CHAINS WITH LINKS OF TWO TYPES

BACKGROUND OF THE INVENTION

The invention relates to chain-making machines, particularly suited for jewelry and the like application, wherein the chain product comprises links of different style and/or shape in a predetermined sequentially connected pattern.

Prior machines of the character indicated are exemplified by Tega, et al., U.S. Pat. No. 4,127,987 and by pending Tega, patent application Ser. No. 877,559, filed Feb. 13, 1978 now U.S. Pat. No. 4,175,379. In machines according to U.S. Pat. No. 4,127,987, first and second auxiliary camshafts are each set up to form a different wire-link size or shape, and a main camshaft determines the pattern in which one or the other of the auxiliary camshafts is to be operative in a program of interlacing the operative status of one to the exclusion of the other auxiliary camshafts, to form a sequence of the different links, in correspondingly interlaced sequence. In machines according to said patent application, a separate counterpliers system is associated with each of two different wire-feeding systems, and a main camshaft provides timed control of the rectilineal shuttling of a pliers unit (and, thereby, the most recently formed link of completed chain) between a first position of association with one counterpliers system and a second position of association with the other counterpliers system.

These and other prior machines of the indicated character have all necessarily operated upon wire as the basic input material, and they have not lent themselves to production of chains of flat links, i.e., from input material other than wire; nor have they lent themselves to production of chains with selectively rounded links and/or selectively square-ended links.

BRIEF STATEMENT OF THE INVENTION

The object of the present invention is a machine for the manufacture of chains having flat links, of the "forzatina", "venetian", and similar types, adapted to provide a plurality of combinations of links of two forms and/or dimensions and/or of different materials, which can be achieved by establishing a given program which can be extensively and rapidly modified.

Substantially the machine in question for chains, with substantially flat links comprises:

two substantially symmetrical machine sections, each provided with horizontal mandrel means of its own, anvil means of its own acting in vertical direction, and feed means of its own;

a slide bearing a rotating unit with pincer shaping tools, which is adapted to be displaced into two working positions pertaining to said two machine sections, transferring the chain to them, the last link formed of the chain being shaped and engaged by said shaping tools;

camshafts provided with continuous motion for the two symmetrical sections of said machine;

opposing engagement means controlled by cams on said continuously moving shafts, via tappets with electromagnetic drive, in order intermittently to drive camshafts for the operating members, alternately, for the two machine sections;

cam means on a continuously moving shaft for tappets with electromagnetic drive in order selectively to drive said slide into one working position or the other and in order to cooperate with blocking means.

The pincer shaping tools are double and are arranged alongside of each other on a head which is slidable diametrically on the rotating unit borne by the slide, and in each working position there are provided means adapted to displace said head diametrically in order to exclude the pincer tools which have transferred the link and displace them outside, and in order to bring into operation the other pincer tools for the links to be formed at the time of the formation of the first link in the position just reached.

The unit which rotates on the slide and which bears the head with the pincer shaping tools can be driven in rotation with alternating motion in order intermittently to engage the chain in one working position of the slide, so as to cause it to rotate in one direction and cause it to rotate in opposite direction in the other working position of the slide. A tray or container—intended to receive the chain formed in either one or the other working position of the slide and imparted intermittent angular motion synchronized with the link-forming cycle—is now driven alternately in the two directions as a function of the position assumed by the slide; means for the engagement of the respective transmissions are driven for engagement after the formation of the first link in the working position just reached; a stop switch is controlled by the movement itself of the tray or container acting for stopping in both directions of the angular motion.

The machine can be provided with anvil tools which can be lowered in order to complete a link which is closed at the bottom (a venetian link), and there are then provided two independent stroke registers of each tool, one of which acts for the closing of the first link formed after the displacement of the slide and the other of which acts for the closing of the following links formed in the same working position. The two registers of one and the same tool may be made active alternatively by the displacement of a block below one or the other of said registers. The machine may comprise means for the cutting of slots or means for the centering of preformed slots, in order to form apparently double, spaced links on one or both of the feeds.

The means for displacing the slide in the two working positions may comprise two drive levers with respective lever tappets controlled by electromagnets, in order to be brought alternatively into cooperation with corresponding cams—generally face cams—which are borne by continuously rotating shafts.

The machine in accordance with the invention furthermore in particular comprises a continuously moving drive shaft which drives two half camshafts also of continuous motion on which they are keyed, one for each half-shaft, two cams of symmetrical development which contribute to presenting the shaped tool groups borne by a slide alternately on one or the other of the two sections of the machine; on the outer ends of the two continuously moving half-shafts there are keyed mechanical members which effect the operation of engagement and disengagement of two intermittently moving half-camshafts on which there are placed cams which separately control the two blocks of link shaping tools; to such intermittently (i.e., discontinuously) moving, half-shafts there are connected via chain transmission another two discontinuously moving half-shafts on which there are keyed the cams relating to the drive of the movements of the shaping tool group.

The machine furthermore comprises two spaced feeder groups each of which receives the movement longitudinal with respect to the front of the machine from the respective intermittently rotating half-camshaft, one group which bears the two pairs of shaping tools, this group being slidably displaceable between two positions of cooperation with the two feeder and link-forming units, the two pairs of tools being mounted on a support which is movable either in transverse direction with respect to the longitudinal axis of the wire or in rotary direction or in vertical direction; two mandrel-holder groups, one for each section of the machine, each of which bears a shaping tool shaped in a manner also different from the other, both with respect to the profile and with respect to the length of the link; two anvil groups one for each section of the machine.

In order to carry out the program of alternations there is provided a programming member for electrical pulses of which are received by a series of detector members which send them to electromagnetic pre-setting members which in their turn change the electric signal into a mechanical drive to actuate the release system of one or the other section of the machine and in order to bring about the translation of the shaping tool group so that it cooperates with one or the other of the two link-forming groups; block detector means are provided in order to interrupt given electric circuits in case of abnormal operations of the machine.

The invention will be better understood from the description and the accompanying drawings, which show one practical non-limitative example of said invention and in particular an "RP" machine which can be made to form a so-called "forzatina" or "Rolo" chain and a "venetian" chain, such chains being sometimes referred to herein by the respective designations "R" and "V". In the drawings:

FIG. 11 shows a detail of a pincer-type shaping tool-holder unit with a wedge driven by an elastic means;

FIG. 12 shows a variant of the tool-holder unit of FIG. 11, with a wedge controlled by an electromagnet;

FIG. 20 shows a few types of chain, representing at M1, M2, M3 variously proportioned links in given chain patterns, with labelled indication of the "R" or "V" nature of the links;

Figure 1:
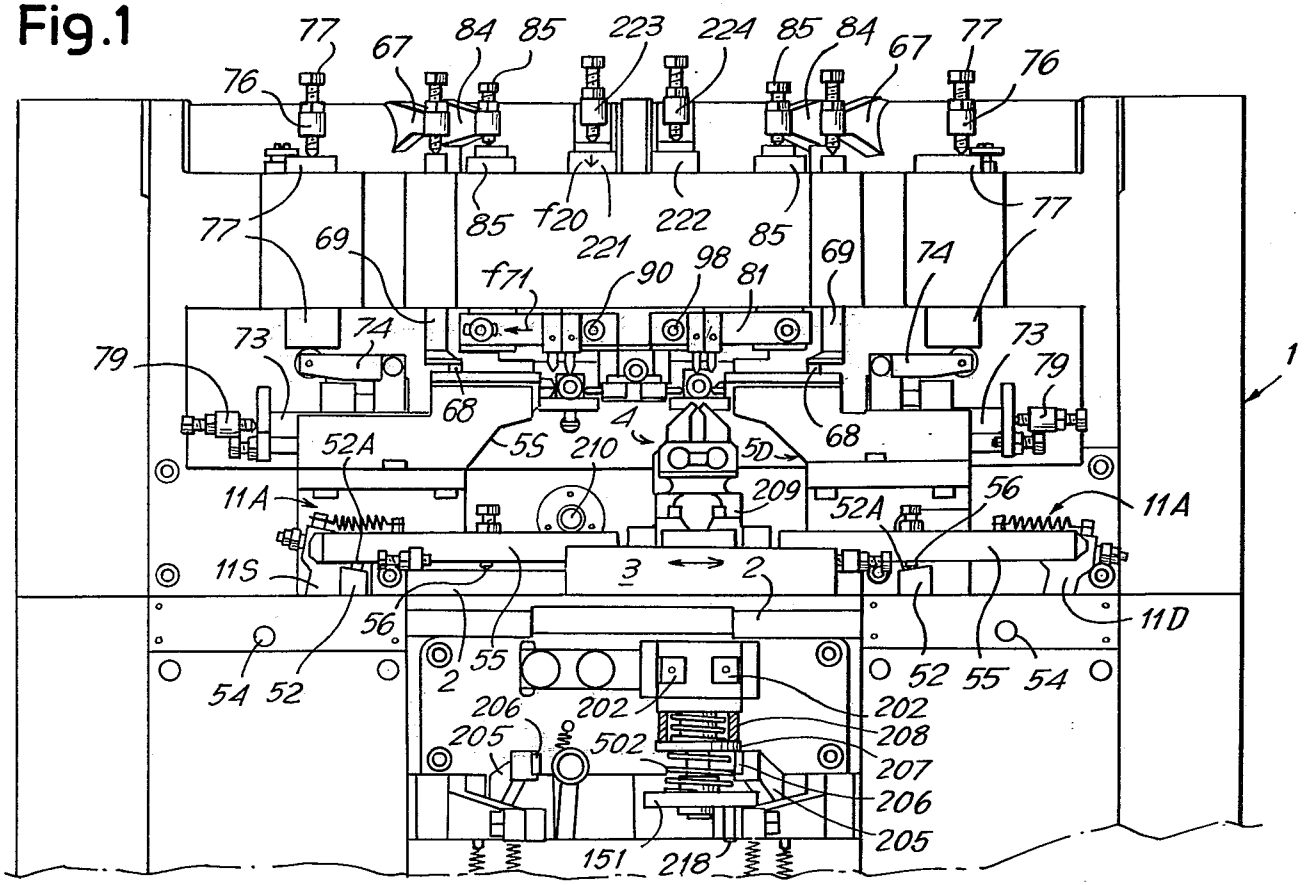
FIG. 1 is a front view of the machine of the invention equipped to form a chain with round links (RP machine)

The machine can be equipped to produce a chain of the type known as "forzatina" or "Rolo" (also Forcat-Figaro), with round links, or to produce a chain of the "venetian" or equivalent type of strip-shaped material with squared links.

Numeral 1 generically indicates a main frame on one face of which there is fixed, in intermediate position, a transverse slide guide 2 (with respect to the front of the frame) for a slide 3 which is capable of being displaced into one or the other of two working positions of a shaping tool group 4, which is borne by said slide 3. The two end positions reached by the unit of the slide make it possible to bring the shaping tool group 4 into cooperation with one or the other of the two opposing feed groups 5S and 5D, and with one or the other of the two link-forming units arranged in the two sections of the machine for the feeding and shaping respectively of the wire or strip intended for the formation of two types of chain links.

These feed groups are known per se in the art, and can be developed in various ways depending on the type of chain which is to be made; the total devices which are connected with the above-indicated units are not expressly described, except as will be pointed out below.

There are described below the means for the attaining, by the shaping tools 4, of the working position with one or the other of the chain-forming units, as well as the means for providing for the actuating of the respective units in proper time when said units come into operation together with the shaping tool group which presents itself in front of them.

The movement is obtained from a drive shaft 6, imparted continuous motion, in the manner indicated below. The said drive shaft 6 serves to drive two half shafts 7 and 8 continuously, causing the displacement of the slide 3 which bears the shaping tools 4 in one or the other of the two positions which it is to reach, and to drive, via two clutches, cam half-shafts with alternating, namely intermittent motion 9A, 10A and 9B, 10B, which serve to drive the tools for the forming of two different types of links.

In order to obtain the displacement of the slide 3 bearing the shaping tools 4, there are provided two oscillating levers 11S and 11D which are connected in suitably articulated and slidable manner at 11A, one to each of the two ends of the said slide 3.

Figure 5:
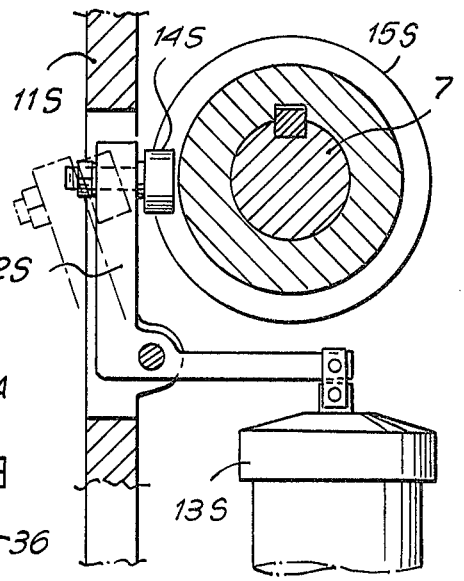
FIG. 5 is a local section along the line V—V of FIG. 1A illustrating an oscillating lever provided for the displacement of the tool-holder slide.

Each of the oscillating levers 11S, 11D has a longitudinal seat in which there is engaged a corresponding bell-crank lever 12S and 12D articulated to the respective lever; each of the two bell-crank levers has an arm driven by a corresponding electromagnet 13S and 13D, borne by the corresponding lever and which, passing from excitation position to a deexcitation position, causes an angular displacement of the corresponding bell-crank lever so as to bring into working position and out of working position a corresponding roller sensor 14S or 14D arranged at the upper end of the corresponding bell-crank lever. The two roller sensors are located in front of the respective continuously driven half-shafts 7 and 8, and in correspondence with a cam 15S and 15D (one one each half-shaft) of symmetrical development which on its own cylindrical surface has a channel of substantially helical development and end zones (see FIG. 5); in said channel there engages or disengages readily a corresponding sensor roller 14S or 14D borne by the bell-crank lever 12S or 12D. When one of the two sensors is brought by the corresponding electromagnet into active position in the channel of the corresponding cam, the sensor engages between the sides of the said channel and with the rotation of the cam together with the half-shaft of continuous movement 7 or 8 is displaced approximately along the axis of the said half-shaft. There is thus caused the angular displacement of the oscillating lever 11S or 11D around its own axis, for displacement from one inclined position to the opposite inclined position.

The movement in the direction opposite to that now examined is obtained when the other one of the electromagnets is excited and the other corresponding sensor placed in position on the cam of the continuously driven half-shaft opposite the preceding one.

After one of the two sensors 14S or 14D has caused the oscillation stroke of the corresponding oscillating lever 11S or 11D, the timely de-energizing of the corresponding electromagnet and the intervention of an elastic means or some other equivalent means cause the disengagement of the sensor roller 14 from the cam 15 which has determined the displacement and the oscillating lever 11S or 11D remains in the position reached, having brought the slide 3 bearing the shaping tools 4 into the working position.

In synchronism with the displacement of the slide 3 bearing the shaping tools 4 from one position to the other by the action of one of the two oscillating levers and therefore of the electromagnetic drives 13, there must be determined the starting of one of the two link-forming units and the stopping of the other. For this purpose there are used drives of mechanical type in order to determine the engagement of the transmission and then the start of the movement of one of the two units at the time when the shaping tool holder group definitely places itself in front of one of the two forming tool units, while electric drive means which are suitably synchronized determine the disengagement of the transmission relating to the unit which itself is to cease working.

Figure 6:
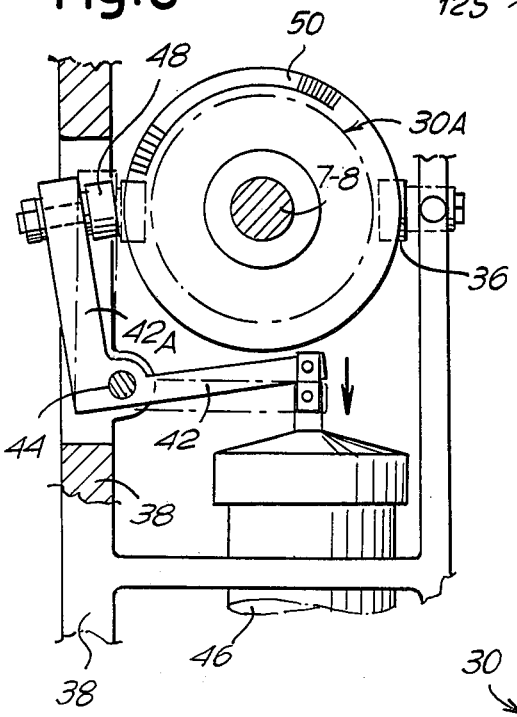
FIGS. 6, 7 and 8 show details of a mechanical clutch for actuating the system for the engagement and disengagement of one or the other section of the machine.
Figure 7:
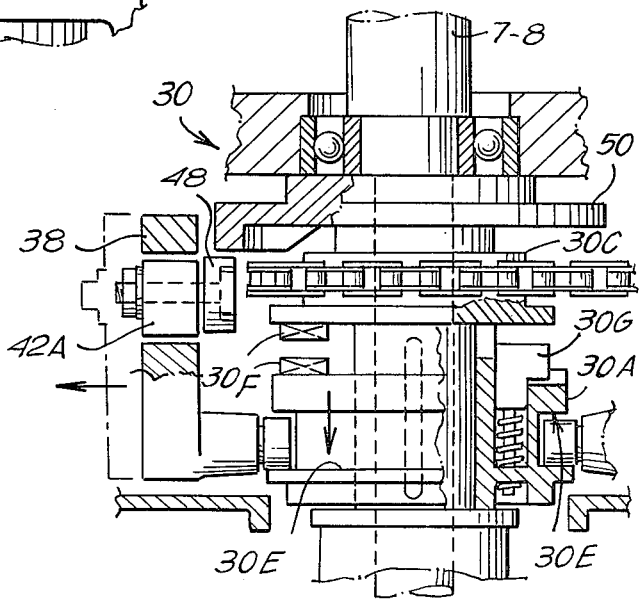
Figure 8:
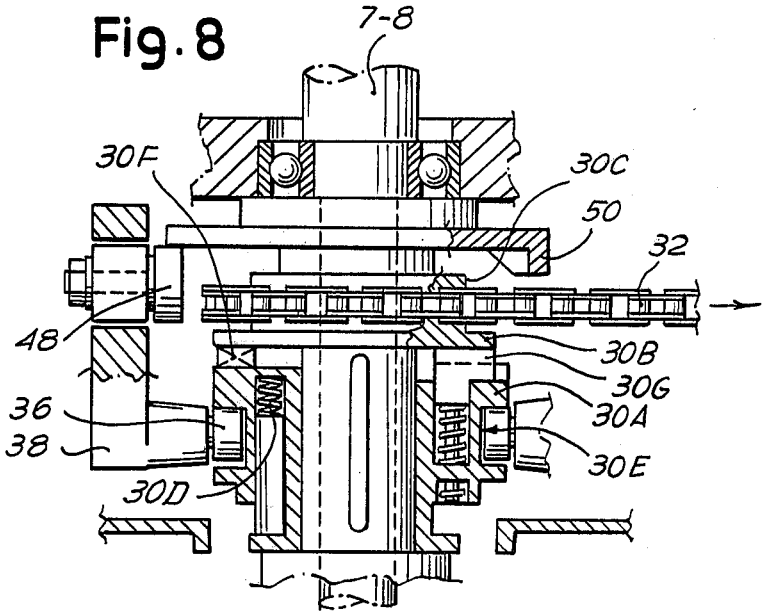

In order to obtain the engagement movement there is provided an engagement unit generically indicated by 30 on each side of the machine, mounted (FIG. 6) on the pertinent end of the two continuously moving half-shafts 7 and 8, and intended to determine the drive of a transmission comprising (FIG. 7) a chain 32 to reach the corresponding cam half-shaft 9A or 10A of intermittent, namely alternating, movement which in its turn (FIG. 8) is connected with another half-shaft 9B or 10B also of intermittent movement with a further chain transmission 32A; the two half-shafts 9A, 10A on the one hand and 9B, 10B on the other hand, cause the movements in the corresponding link-forming group and the necessary drives for the movements of the shaping-tool group. The four half-shafts of intermittent movement are each developed by half of the front of the machine and those 9B, 10B which determine the movements of the link-forming group are arranged in pairs above the frame and the two half-shafts 9A, 10A which determine the movements of the shaping tool group are arranged in pairs below the frame. Each half shaft of alternating motion bears a plurality of cams known per ser, cooperating with respective levers for the drive of the various members; these drive levers or the like have also not been especially illustrated or described, since they are of the type known to those skilled in the art.

At each end of the two continuously moving half-shafts 7, 8 there is provided, as already stated, a front claw clutch 30 which may have a single engagement position when this is necessary for given drive requirements. The clutch comprises a drive member 30A which is also displaceable on the half-shaft but capable of rotating with it; there is idly mounted on the half-shaft a driven member 30B rigidly connected to a sprocket wheel 30C for the chain 32. Spring means 30D urge the drive member 30A into engagement with the driven member 30B while, through an annular groove 30E of the said member 30A, the latter can be driven away, namely for the disengagement; in addition to the rigid clutch teeth 30F, the drive member 30A has an elastic tooth 30G which serves to accompany the driven member 30B to practically the end of the disengagement stroke in order to avoid phase shifts. In the groove 30E, there are engaged two rollers or shoes 36 borne by a forked lever 38 pivoted at 40; on the lever 38 there is mounted a small lever 42 pivoted at 44 and driven by an electromagnet 46. This electromagnet 46 can push the upper end 42A of the small lever 42 into a remote position and into a closer position respectively with respect to the half-shaft 7, 8 of continuous motion; the bell-crank lever 42 bears at the said upper end a roller sensor 48 which, when brought close to the half shaft, is capable of entering into cooperation with a face cam 50 mounted on the said half shaft and rotating constantly with it. Therefore, the drive of the electromagnet 46 gives the consent to making the sensor 48 active; when said sensor is brought into correspondence with the path of the cam 50, the latter causes the displacement of the forked lever 38 around the axis 40 as soon as and at the moment when the protruding part of the cam 50 acts on the sensor 48, in perfect phasing with the half shaft of continuous motion 7 or 8 and with the corresponding cam 15. This displacement causes the disengagement of the cluch 30 against the action of opposing elastic means which urge the engagement movement. The condition of disengagement of each clutch 30 is stabilized by a mechanical retaining system which is acted on by the slide 3 and which is described below.

The lever 38 has a stop 51 (FIG. 1A) with which there cooperates an end tooth 52B formed by a bell-crank lever 52 oscillating around a pin 54 mounted on the frame. Since there are two forked levers 38 at the opposite ends of the machine for the two transmission clutches 30, there are two small levers 52 and both are aligned with corresponding appendages 55 of the slide 3 bearing at its ends corresponding pins 56 capable of acting on the inclined surface 52A of the end of the corresponding small lever 52. When the slide 3 is displaced in one direction, the pin 56, which is on the side towards which the slide is displaced, at a certain point acts, at the end of the stroke of the slide 3 bearing the shaping tools, on the inclined surface 52A, causing a displacement of the small lever 52 around the pin 54, to which there corresponds the lifting of the tooth 52B, which has remained in engagement with the stop 51 in the disengagement position. Under these conditions of lifting of the tooth 52B, the forked lever 38 is disengaged from its own stop 51 by the retaining tooth 52B, and the elastic means cause the connecting of the corresponding clutch 30 in the manner already described in order to cause the actuating of the corresponding chain 32 and of the half shafts of alternating motion 9A, 10A or 9B, 10B.

When the slide bearing the shaping tools is displaced in direction opposite the above direction, and therefore the pin 56 moves away from the corresponding small lever 52, the tooth 52B tends to again descent elastically as a result of a spring 52E, and is thus ready to resume contact with the stop 51 as soon as the lever 38 has been displaced in the direction of disengagement of the respective clutch 30 by means of the cam 50 acting in due time on the sensor 48, which in the meantime will have been placed in the working position by the excitation of the electromagnet 46. After the cam 50 has stopped its own push in clockwise direction on the lever 38, and the latter tends, through the elastic means 30D, to again bring the two members 30A, 30B of the clutch together, the stop 51 is brought against the tool 52B again under the disengagement conditions until a new action of the slide bearing the shaping tools again causes the lifting of the tooth 52B and thus the release of the lever 38 and the connecting of the clutch.

The actuating of one or the other of the two link-forming units is obtained by the mechanical drive effected by the means 54-56-52-52B, which bring the clutch, and therefore the two respective half shafts of alternating motion, into action while the disengagement is obtained by presetting on the part of the electromagnet 46 and suitably synchronized drive on the part of the cam 50.

Each of the pairs of half shafts of alternating motion is combined with a device for locking the said half shafts in well-defined angular position. This device comprises (FIG. 9) a tooth 1101 on a wheel 1103 locked on the lower half shaft 9A or 10A of intermittent motion in question. Adjacent the wheel 1103 there is mounted a small lever 1105 articulated by means of a slot 1107 to a fixed pin 1109. The said lever is under the action of a spring 1110 so as to press by a tappet roller 1112 against an inclined surface 1114A of a block 1114 borne by the frame of the machine. The lever 1105 bears a fixed tooth 1116 and a tooth 1118 which oscillates around an articulation 1118A and is under the action of a spring 1120. When the chain 32 ceases positively to drive the ocrresponding half shaft of alternate motion 9A or 10A as a result of inertia or other stresses, the tooth 1101 comes to push the oscillating tooth 1118 against the action of the spring 1120 and therefore to overcome it, entering into contact with the tooth 1116, while the lever 1105 is urged in the direction indicated by the arrow f1000, by the spring 1110, by reaction between the inclined profile 1114A and the roller 1112; as soon as the tooth 1101 has passed the tooth 1118, it makes contact with the tooth 1116, while the tooth 1118 escapes in back of the said tooth 1101, which thus remains engaged between the teeth 1116 and 1118. If the inertia is slight and if the reactions of the tappets acting on the cams of the half shafts are limited, the said half shafts remain blocked; otherwise, they tend to displace the lever 1105, overcoming the action of the spring 1110, until they are brought into the position established by the spring itself, by the profile 1114A and by the end of the slot 1107. Upon a subsequent starting, the tooth 1101, driven in rotation, displaces the lever 1105 which moves away along the profile 1114A until the release of the tooth 1101 from the tooth 1116.

When the slide 3 bearing the shaping tools 4 reaches one of the two working positions by the control of one of the two oscillating levers 11, it can be blocked against further displacements with respect to the guide itself. For this purpose (FIG. 11) in both the positions there is provided a stop tooth 130 which is acted on by a spring 132 and penetrates into a recess 133 in the slide 3, for the locking of the latter. The unlocking of the tooth 130 is actuated by action on a sensor 134 on the tooth 130 on the part of a corresponding slidable bar 136 which has an inclined profile for the driving of the sensor 134 and is urged in one direction by a spring while in the opposite direction it can be thrust by an appendage 38F of the corresponding forked lever 38. The locking and the unlocking of the slide 3 bearing the shaping tools 4 are thus synchronized with the movements of the lever 38 for the drive of the clutches 30.

Since the feeders, the mandrel-holder groups, the stops 60S, 60D, the shaping tool holder group, the butter group and the anvil groups are all devices known in the prior art, certain parts thereof will not be described.

Figure 2:
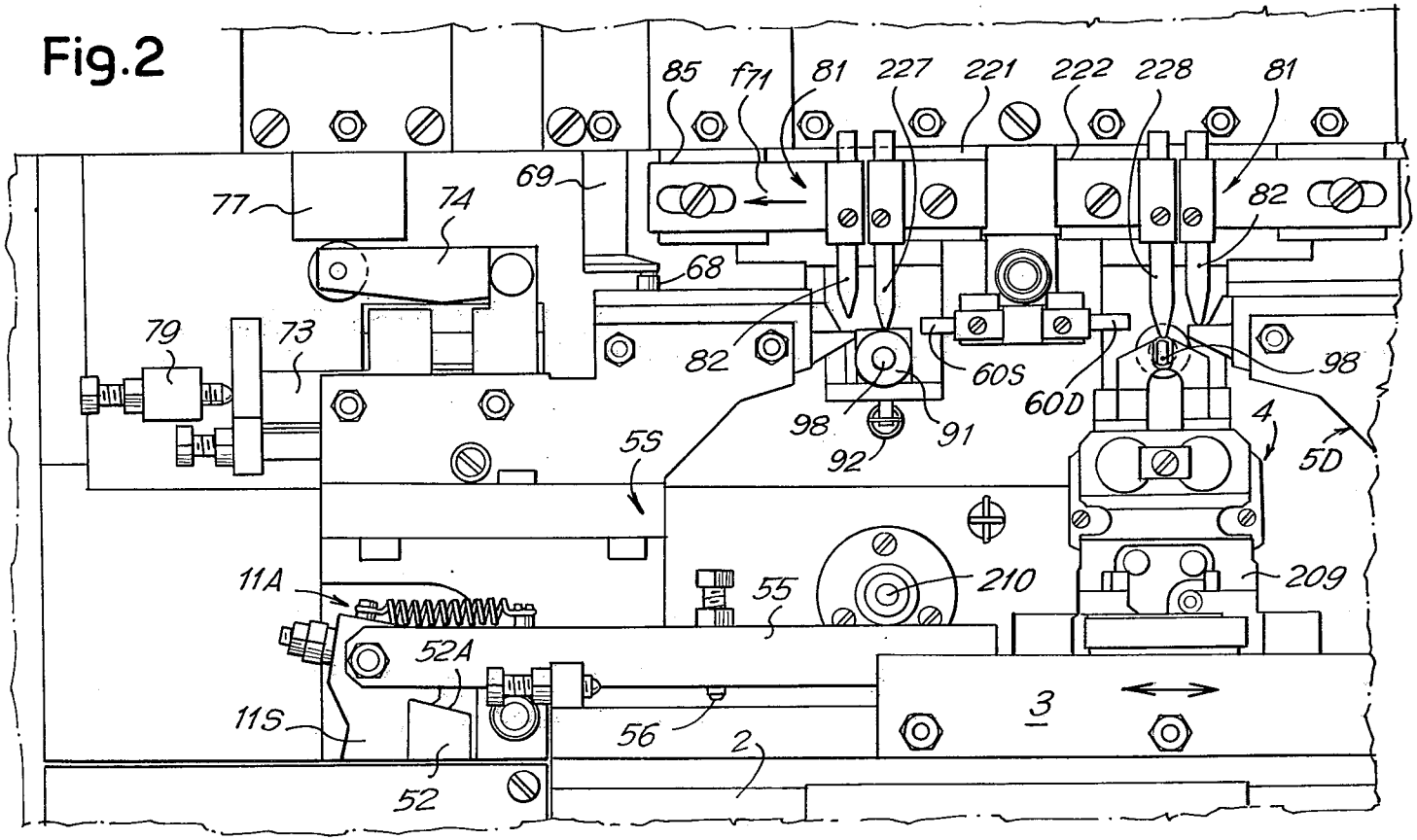
FIG. 2 shows on a larger scale a detail of the link-forming groups of the machine (RP) of FIG. 1.

In each of the feed groups 5D and 5S, respectively, there is formed a guide on which there slides a slide 73 which bears a chuck 74 which clamps the wire so that it can be fed during the stroke of the slide 73 itself (FIG. 2); the drive for clamping the wire is established by a cam 75 and, via the rocker 76 and a tappet 77, is transmitted to the chuck 74. The drive for the advancing of the slide 73 is provided with a lever 79 via a face cam 71 while the return into initial position takes place via an elastic means. Before the slide 75, after having fed the wire, returns into its initial position, the action of the rocker lever 76 ceases and the wire is thus freed from the action of the chuck 74, while the action of a tappet 69 commences on the wire-press 68 via a rocker 67 and the cam 66 so as to retain the wire and avoid it being carried along by friction by the chuck 74 which is rigidly fastened to the slide 73 upon the return stroke of the latter. The stops 60D and 60S opposite the feeder 5D and 5S hold the wire in such a manner that at the time of the cutting it always maintains its center line in correspondence with the vertical axis of the group of corresponding shaping tools.

After the wire has been fed, a cutting group 81 descends and the knife 82 cuts the said wire, driven by a cam 83, a rocker lever 84 and a tappet 85; the cutting group can be registered in the direction of the arrow f71 within a guide formed in the tappet 85.

In each working position there is provided a mandrel group 90 which slides in a guide formed in a member 91 in the direction indicated by the arrow f80 (FIG. 10), driven by a tension spring 92, while in order to effect the stroke in the direction opposite to that indicated above it is driven by a lever 93 to one end of which there is fastened a plate 94 which acts on a pin 95 fastened to the group 90; to the other end of the group 90 there is fastened a plate 96 which bears a registration screw 97 which defines the stroke, in the direction indicated by the arrow f80, of the said group 90, while at the front end of the group 90 there is fastened the mandrel 98 shaped like the internal profile which the link is to assume; in the lower part of the mandrel 98 there is produced a grooving in direction longitudinal to the mandrel itself, so that at the time of the forming of the link, the link previously formed does not undergo any change upon entering into contact with the said mandrel.

In the forming of the link there participates, together with the mandrel group, also the shaping tool group 4, in the upper part of which there are fastened the two pairs of tools 214, 215 (FIG. 11) which enter alternately into working position in order to form the corresponding link.

As previously described, this group can move from one working position to the other or, better stated, can present itself alternately in one or the other of the two sections of the machine.

Figure 4:
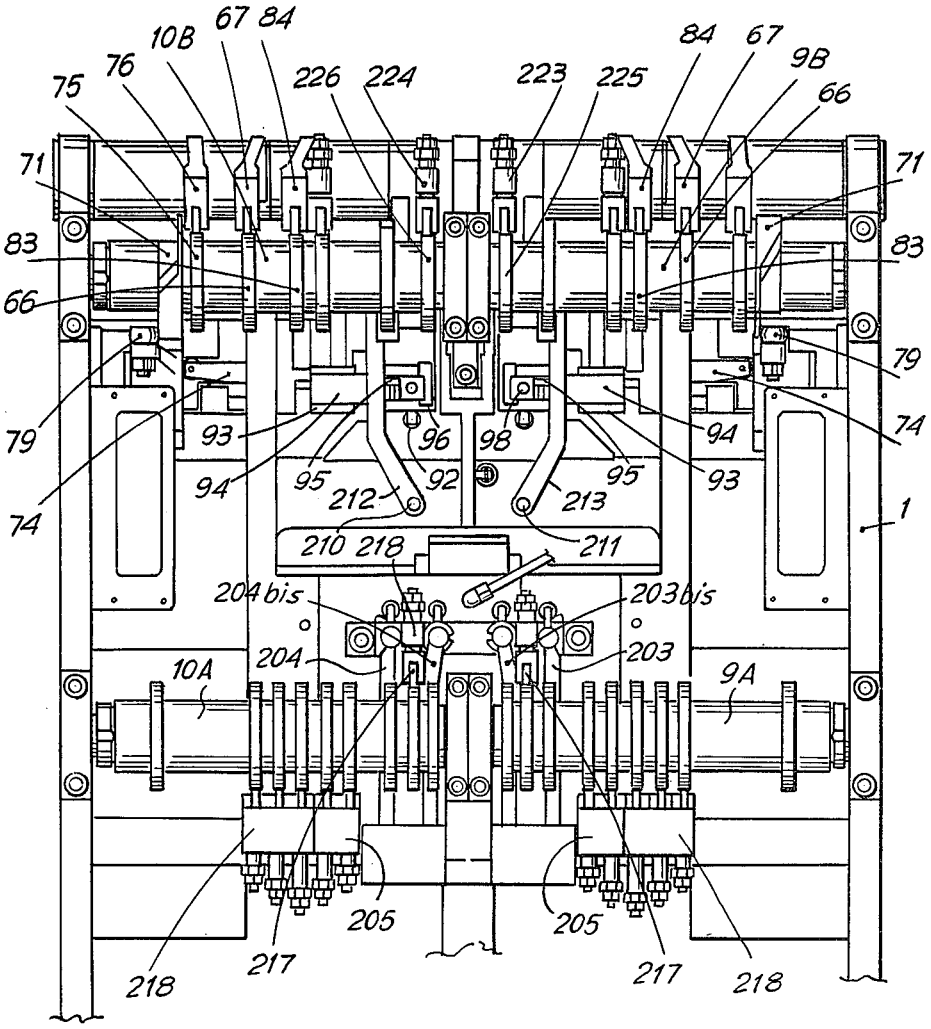
FIG. 4 is a rear view of the machine (RP) of FIGS. 1 and 3.

The shaping tool group 4 is composed of a toothed shaft 201 which can rotate around its own axis, driven for this purpose by a pair of racks 202 which are alternately actuated by the levers 203, 203 bis (FIG. 4) when the group is in the left-hand section of the machine and by the levers 204, 204 bis when the group is in the right-hand section.

The toothed shaft can also slide vertically in the direction indicated by the arrow f100, driven by the lever 205, at the end of which there is arranged the curved block 206 which acts on a ring 207 rigidly connected to said shaft; movement in direction opposite to the arrow f100 is controlled by a spring 208.

Figure 4A:
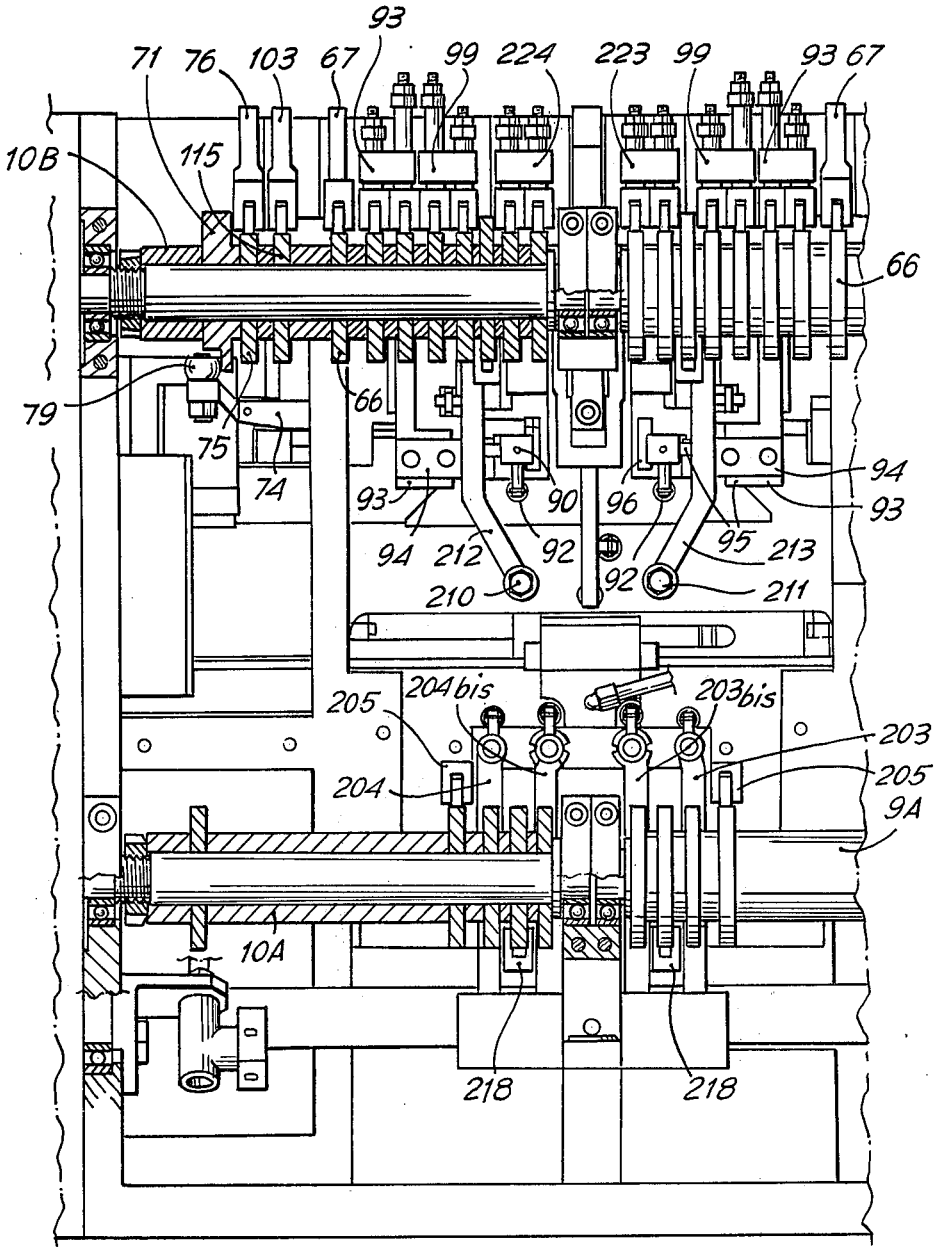
FIG. 4A is a partial rear view of the machine ("venetian") of FIGS. 1A and 3A.
Figure 10:
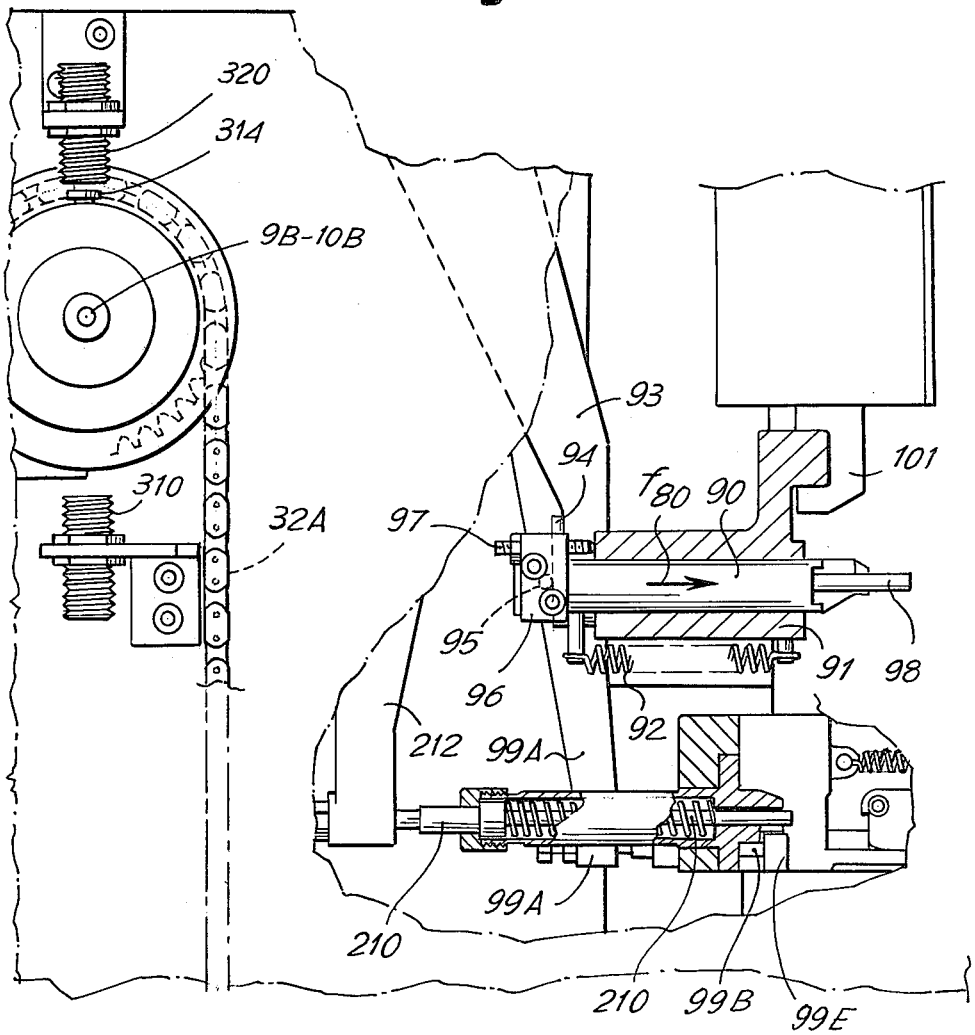
FIG. 10 shows some drive members combined with a pincer-type shaping tool-holder unit.

In the upper end of the toothed shaft 201 there is formed a guide on which the tool-holder head 209 can slide transversely in the direction indicated by the arrow f10; the transverse movement of the head is effected via two tappets 210 and 211, one for each section of the machine, driven by the levers 212 and 213 respectively (FIGS. 4A,10). When the right-hand part of the machine enters into action, the lever 212 drives the tappet 210 which, by displacing the head towards the outside in the direction indicated by the arrow f10, brings the pair of shaping tools 214 into operating position. Upon changing the cycle in the opposite section of the machine, the head will rotate in the direction opposite the previous direction, so that the tappet 211, via the lever 213, will again cause the head to move towards the outside in the direction indicated by the arrow f10, bringing the pair of shaping tools 215 into working position.

Within the toothed shaft 201 there slides the wedge 216 which closes the pair of shaping tools 214 or 215 which actively participate in the link-forming operation, said wedge 216 being driven by a lever 217 or by a spring 502 (FIG. 11), while the lever 218 assures the positioning of the wedge during the phase of the opening of the shaping tools 214 and 215.

At the time when the group of shaping tools effects the movement of translation from one section to the other of the machine, the wedge 216 must remain engaged in closing phase, so that the pair of tools which has formed the last link does not open and permit the chain to fall.

For this purpose there may be provided either an electromagnet 500, which upon being energized in synchronism with the commencement of the translation, brings about the angular displacement of the small L-shaped lever 150 (FIG. 12) engaging it against the ring 151 of the wedge 216, or the spring elastic means 502.

Figure 3:
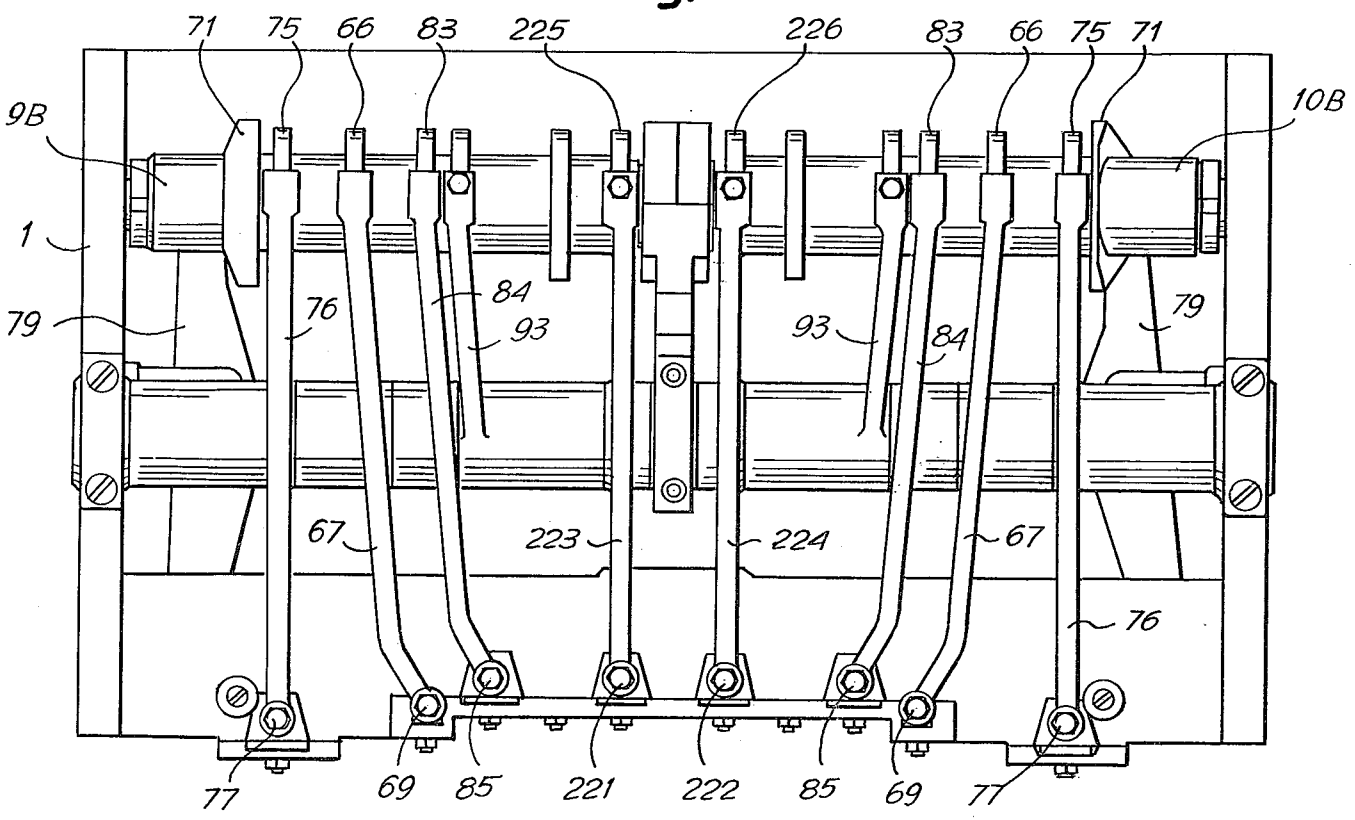
FIG. 3 is a plan view of the machine (RP) of FIG. 1.
Figure 3A:
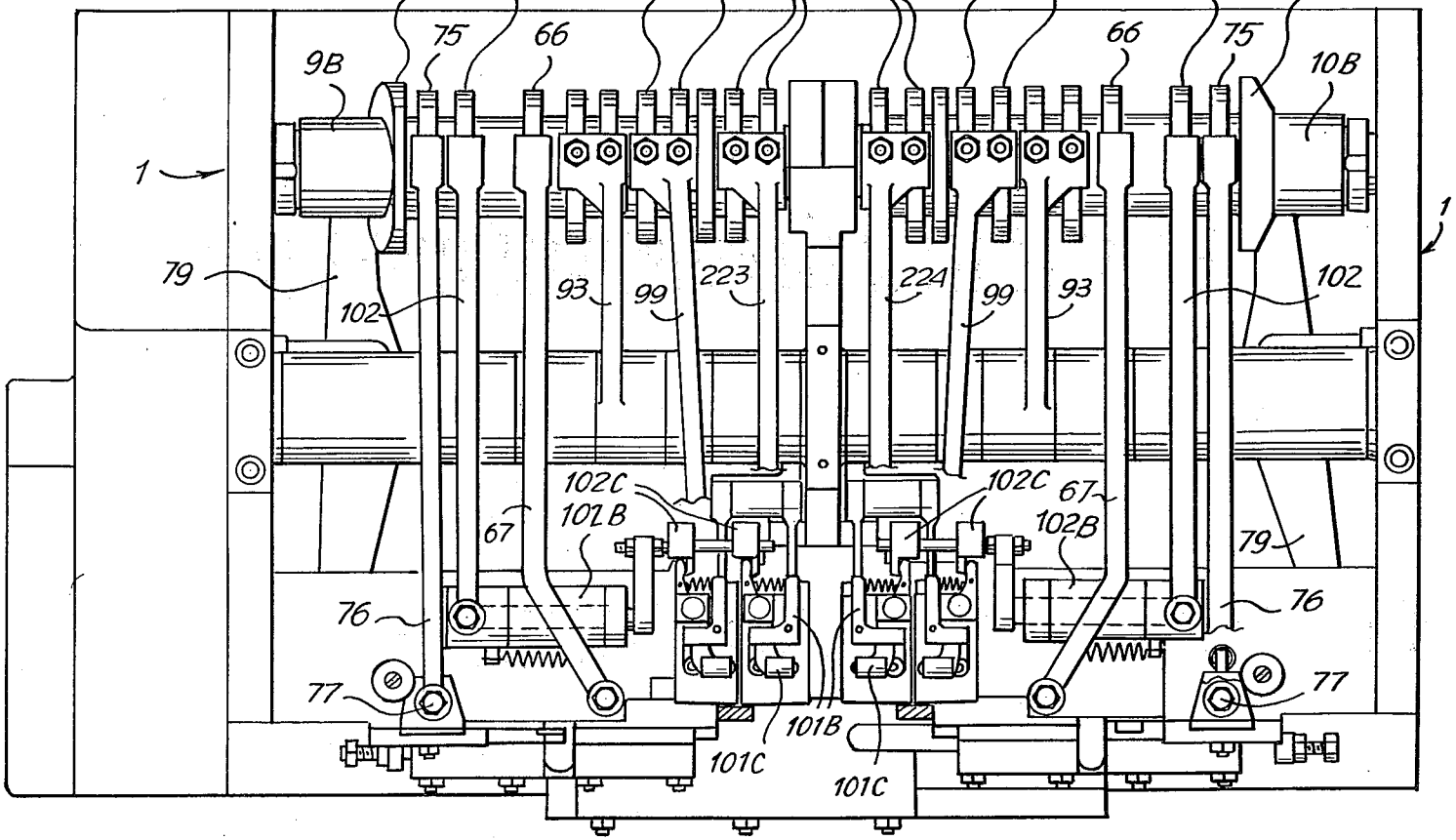
FIG. 3A is a similar plan view of the machine ("venetian") of FIG. 1A.

Another device which participates in the construction of the link is the anvil-holding group (FIG. 1), one for each section of the machine, which group is fastened on a slide formed of the tappets 221–222 (FIG. 3); these tappets are slidable vertically in the direction indicated by the arrow f20 and driven by levers 223 and 224 via cams 225 and 226 (FIG. 3).

The anvils 227 and 228 have the end which enters into contact with the links shaped in such a manner as to be able to effect the closing of said link in such a manner as not to deform the profile.

There will now be described an illustrative cycle with a 1:1 program, in order to make the operation of the groups described above clearer, assuming that we are starting from the right-hand section of the machine.

To the cam half-shafts of intermittent motion 10A and 10B, the rotary motion is transmitted through members of fixed ratio from the continuously moving half shaft 8. Thereupon the slide of the feed group 5D for feeding the wire necessary for the forming of the link is acted upon. The wire fed, after it has been threaded within the previously formed link, enters into contact with the mechanical stop 60D; at the same time, the pair of shaping tools 214 which held the previously constructed link opens and rotates 90° in clockwise direction, while the tool-holder head 4 is displaced in direction transverse to the wire so as to bring the pair of shaping tools 215 into working position with respect to this cycle. At this point, the horizontal mandrel 98 also enters into contact with the wire, forcing it against the shaping tools. The tool 98 in its lower part has a groove into which there enters the upper part of the link previously formed engaged by the blank just fed, in such a manner that it is not deformed and cannot interfere with the subsequent phase of forming. The right-hand cutter 82 can now be actuated, it cutting the wire blank which is bent both by the mandrel 98 and by the shaping tools 215 involved in this cycle. Before the mandrel 98 emerges to disengage the link thus formed, the anvil 228 descends and closes the said link in final manner. After this has been done, the tool-holder head 209 rotates 90° in the direction opposite the preceding direction, coming into the linking position.

At this point, the program transmits the signal which, via electromagnetic execution members, is changed into a mechanical control of disengagement of the half shafts 10A and 10B of the right-hand section; the two half shafts must be stopped in the predetermined position (with the mechanism 1116–1118 described) in order that a new cycle can then start.

Simultaneously with the stopping of the half shafts 10A and 10B, there commences the translation of the slide 3 and of the tool-holder group 4 until the latter reaches the left-hand section of the machine, bringing about the displacement of the side forked lever 38 and therefore the engagement of the half shafts 9A and 9B, as a result of which the cycle is repeated in the left-hand part with the same phases as described for the right-hand part, with the exception of the fact that the tool-holder head 209 will rotate 90° in counterclockwise direction rather than in clockwise direction, and that the link is formed by the groups 5S, 82, and 227.

The machine can also be equipped for the production of a chain from metal strip, the links of which may be of square or rectangular shape ("venetian"), alternating in accordance with shape and/or dimensions, or of the same shape and dimensions but with strip of different material.

In order to obtain the above, it is necessary to replace the link forming tools previously described by other tools adapted for the development of this different type of link, the general concept of operation remaining the same.

Although these tools are well-known to those skilled in the art, certain parts thereof will be described.

The feed group and the other members connected to it are identical to those previously described, while the stops 60D–60S are no longer necessary.

At the front end of the group 90, the mandrel holder 98A has a double mandrel 999A–999B formed of bars having the following functions: the bar 999A (FIG. 13) of rectangular profile serves as abutment for the link-forming tool or hammer (2000, 2003) in order to effect the first shaping of the strip blank N fed; the bar 999B of quadrangular or rectangular profile is of smaller cross section than the preceding one and similar to the internal dimensions which the link is to assume. The mandrel-holder group is displaceable also in vertical direction, driven by the lever 99 via the cams 112 and 113 which displace the tappet 101 on which the member 91 is fastened.

Another device which participates in the forming of the link is the anvil group, one for each section of the machine, which is fastened on a guide formed in the tappet 221 and 222; this tappet is displaceable vertically, driven by the lever 223 and 224 via the cams 225, 226.

Figure 13:
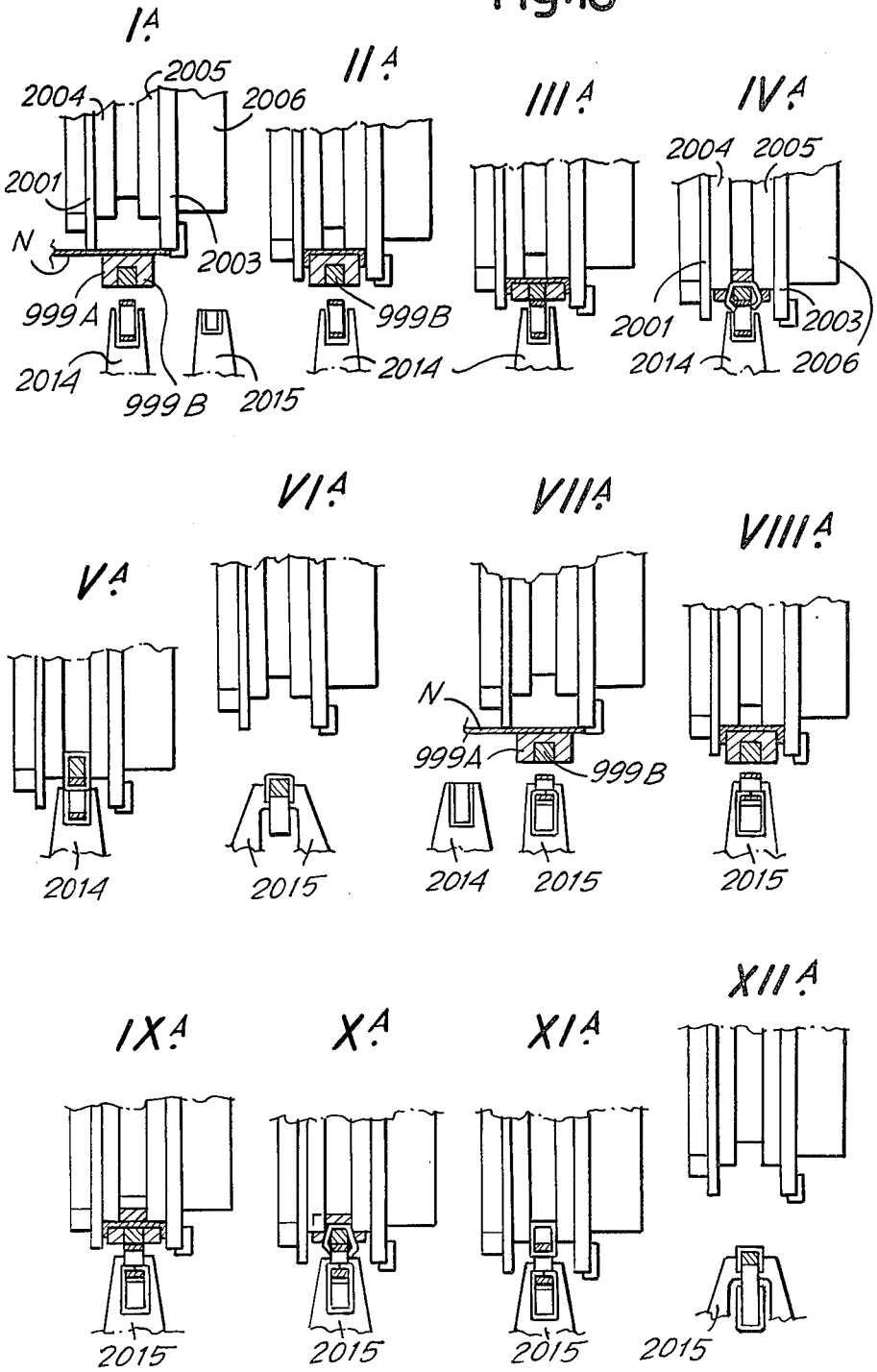
FIG. 13 shows a series of phases of a work cycle for the closing of a so-called "venetian" link, with cooperating tools.

The anvils are formed by a main support 2006 on which there are applied shims 2001, 2003 and 2004, 2005, by which the two profiles are formed for the first bending of the strip blank N and for the final bending for the shaping of the link respectively (FIG. 13).

On the side of the principal support adjacent to the strip holder of the feed group (5D or 5S) there is fastened the plate shim 2001, which acts also as cutter, so that the anvil, in its vertical stroke, first cuts the strip thickness and then effects the first forming of the link.

The shaping tool group is substantially identical to that previously described, except for the fact that the toothed shaft 201 is blocked in position to prevent it from sliding in vertical direction.

For this variant also there will now be described the carrying out of an illustrative cycle with a 1:1 program, assuming that we start from the right-hand section of the machine. To the cam half-shafts of alternating motion 10A, 10B, the rotary motion is transmitted, via members with a fixed ratio from the half shaft 8 of continuous motion. The slide 73 of the feed group 5D is then driven to feed the strip blank necessary for the formation of the link. The feed strip passes between the anvil 2006 and the mandrel 999A; at this point the anvil commences the phase of descent so that the plate 2001 (which acts as cutter) separates the blank fed from the rest of the strip. The descent of the anvil continuing, the first bending of the strip blank is effected by the combined action of the mandrel 999A which acts as abutment and the deforming action of the anvil itself (FIG. 13). After the first shaping has been effected, the mandrel group withdraws in the direction opposite that indicated by the arrow f80, until it brings the second mandrel 999B into working position, which acts as abutment for the second and final link-forming operation, carried out in the second phase of descent of the anvil. The ends of the link, during the last forming phase, come together after having entered into the opening of the link previously formed. The anvil at this point returns into its raised position of rest while the shaping tools 2014, which held the previously formed link, open and rotate 90°; the link which has just been formed in this phase remains engaged in the small mandrel 999B, which descends to position itself in such a manner that the shaping tools 2015 in the following closing phase take hold of the link in question. At the same moment that the shaping tools terminate the link-engagement phase, the mandrel 999B moves back, releasing the said link and permitting the shaping group to rotate again 90° in the direction opposite the preceding direction (and therefore to return to its initial position) into the linking position. At this point, the program transmits the signal received from the detector element and—as described above—the machine is set to start a new cycle in the section opposite the one described.

Figure 14:
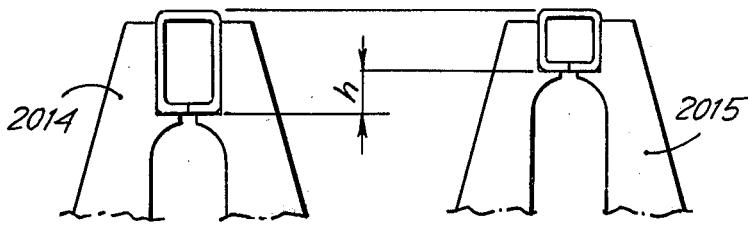
FIGS. 14, 14A and 14B show details of a pair of tools constructed with a possible irregularity, comprising a difference not corresponding to the difference in length between the two links of a chain.
Figure 14A:
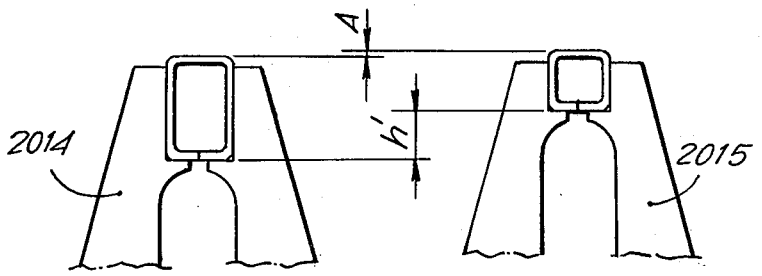
Figure 14B:
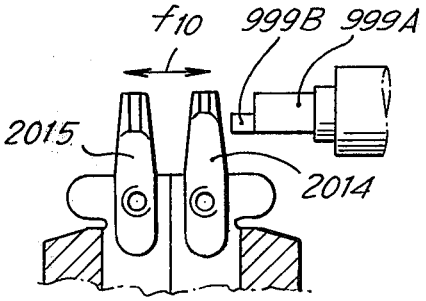
Figure 15:
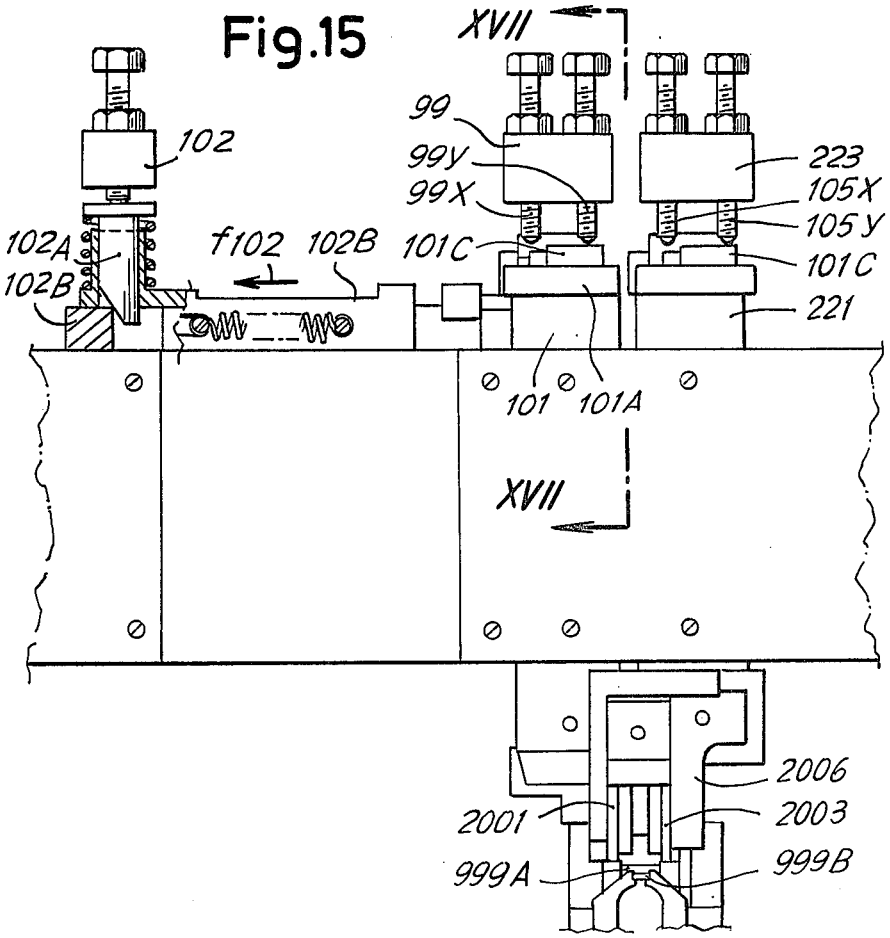
FIGS. 15, 16, 17 and 18 show a device for correcting an error in construction of the pairs of tools, such as indicated in FIGS. 14 and 14A.

The machine affords the possibility of producing a plurality of combinations of links of two shapes and/or different dimensions, also with respect to the cross-section, in addition to the quality, of the wire suitable for the construction of the said links. There thus arises the necessity—there being two pairs of shaping tools and the construction of said pairs being possibly also effected in different manner—of bringing about the movement of vertical descent of the mandrel and of the anvil during the operation of the forming of the first link in a manner different from the movement of descent in the operation of the forming of the subsequent links. On the slide 3, the group of shaping tools 4 has two pairs of shaping tools and the group is caused to undergo a movement of translation with respect to the slide 3 in order to cyclically replace the two pairs of tools which are developed in ordinary manner so that the upper part of the link, borne by each of them, lie on the same theoretical plane, and that (if the two links are of different lengths) the value h (FIG. 14) is entirely identical to the difference in length between the two links. FIG. 14A shows two pairs of shaping tools 2014 and 2015, developed in irregular, namely non-precise manner, so that the upper parts of the links borne by each of said pairs, can lie on two different planes and the value h' cannot correspond to the difference in length between the said two links.

It is furthermore noted that even if the program of the machine is 1:1, both the pairs of shaping tools participate in a complete cycle; assuming a hypothetical error in construction of such pairs, the necessity arises of having a device capable of obviating this drawback. As can be seen in particular from FIGS. 15, 16, 17, and 18, this device is placed in the upper part of the tappets 101 and 221. One device comprises a plate 101A on which there are hinged both the block 101C on which the two registers 99X, 99Y of the lever 99 act separately and the stop tooth 101B. The block 101C is freed from the stop 101B by the lever 99A, controlled by the tappet 99B actuated by an inclined plate 99E placed in the slide 3 bearing the shaping tools; the said block 101C is brought back into initial position, namely engaged by the stop 101B via the lever 102 which causes the wedge 102A to actuate the slide 102B, and therefore the blocks 102C, in the direction indicated by the arrow f102.

Figure 16:
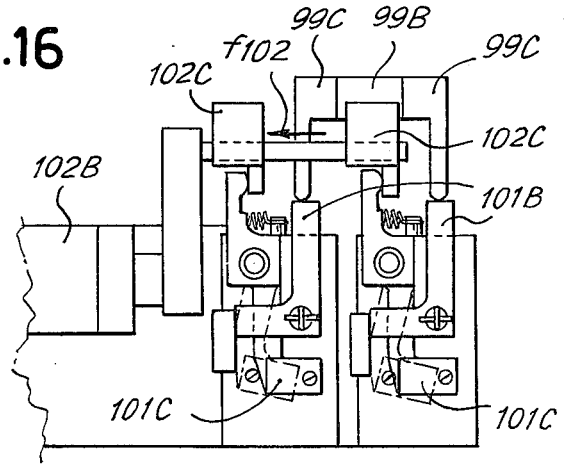
Figure 17:
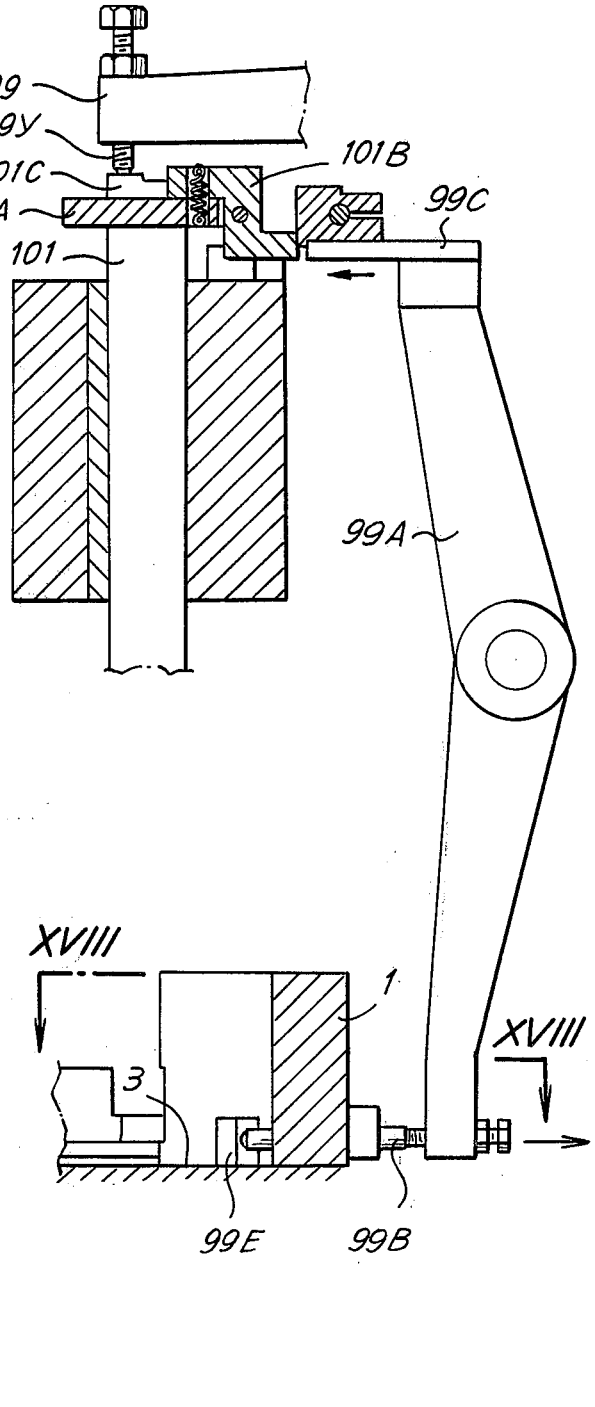
Figure 18:
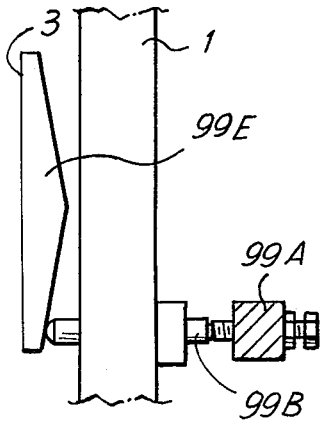

The operation of the device is as follows:

Assuming that we start from the phase of translation from the right to the left of the shaping-tool holder slide 3 during the translation phase, the inclined plate 99E placed on the shaping-tool holder slide 3 actuates the tappet 99B which controls the displacement of the lever 99A on whose upper parts the blocks 99C are fastened; these blocks lift the corresponding stop teeth 101B (against the action of the respective traction springs) and the block 101C is free to move, controlled by an elastic means, into the position shown in dashed line in FIG. 16. At the end of the translation, the pair of shaping tools 2019 (FIG. 13), which bear the last link formed in the right-hand section of the machine, position themselves in correspondence with the mandrel 98A and the anvil 2006 which are placed in the left-hand section of the said machine. The mandrel and the anvil commence the link-forming phase, controlled in this by the left-hand register 99X and 105X of the levers 99 and 223, until they return into position of rest (FIG. 13 between phases $VI^4$ and $XII^4$); the lever 102 at this point drives the wedge 102A which displaces the slide 102B and then the blocks 102C in the direction indicated by the arrow f102, returning the blocks 101C into the position indicated in solid line in FIG. 16; the stop teeth 101B moving down, proceed to engage said blocks 102C in such position until a new translation of the shaping tool holder slide is effected, like the one which has been described. There then starts the construction of the second link in the left-hand section and the mandrel and the anvil, the shaping tools 2015 being now active, will carry out a vertical stroke which may be different from the previous one, driven in this by the registers 99Y and 105Y placed on the right of the levers 99 and 223. It is obvious that the presence of two registers 99X and 99Y and 105X and 105Y respectively, which are alternatively active, makes it possible to register the stroke of the tools connected to the slide 101 and 221 respectively, in relation to the dimensional characteristics of the two pairs of clamps 2014, 2015, or the like, which are arranged on the machine in order to compensate for the lack of precision. The displacement of the slide 102B, after the first cycle, namely after the formation of the first link on the part of the left-hand section of the machine (as stated in the foregoing explanation) is obtained with the shaping of the cam 114 which acts on the lever 102.

It is known to those skilled in the art that chains formed of links of flat type require certain measures in order to prevent the chain from accumulating irregularly or tending to become entangled. For a machine with two working positions, it is necessary that the chain be accumulated in a tray or other container, arranged at a distance below the working zone formed of the two link-forming units; said container or tray must be able to rotate, in clockwise and counterclockwise direction, along a vertical axis approximately passing through an intermediate position between the two opposite working positions, with an advance which is programmed as a function of the programming of the links of different type by which the chain is gradually formed.

Figure 19:
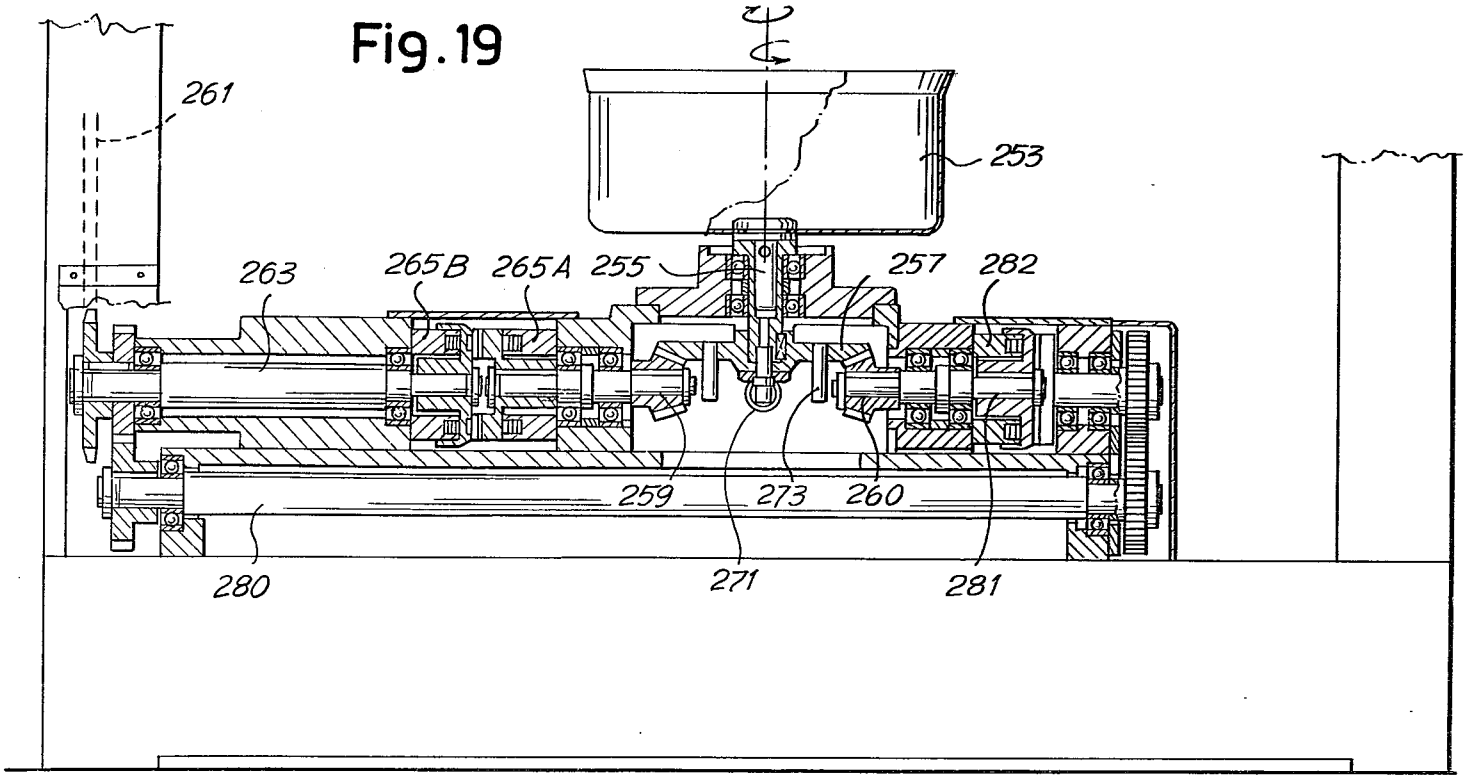
FIG. 19 shows a detail of a tray container located below the work groups and rotating in order to prevent the chain from being accumulated irregularly, or tending to become entangled.

In accordance with the drawing (FIG. 19), there is provided a tray container 253 mounted for rotation around a vertical axis, represented physically by a shaft 255 which has at the bottom a bevel toothed ring 257 engaging with two bevel toothed pinions 259, 260 to constitute a step-down transmission from a motor which drives both the drive shaft 6 of the machine, and via chain 261, the means for actuating the bevel pinions 259 and 260. These means comprise a shaft 263 which is the drive shaft of a brake-clutch group 265A–265B and is adapted to also drive a shaft 280; this shaft 280, via a gear transmission, in its turn drives a shaft 281 of a clutch group on which the bevel pinion 260 is mounted. The brake-clutch system 265A–265B and the clutch 282 are of preferably electromechanical type, and their drive is subject to the program for the forming of the chain which is being carried out at that time by the machine.

For the stopping there can be provided, rather than a control on the program, a control as a function of the movement effected by said rotating unit; for this purpose there may be provided, for instance, a proximity switch 271 located to the side of the box in which the toothed ring 257 is located, in order to cooperate with one of the several appendages 273 which are mounted on the disk of the toothed ring 257 and which come in front of the proximity switch 271 after having passed over a certain distance of the circular path as a result of the rotation of the unit 253–257. It can be seen to it, for instance, that the stop is brought about after one-quarter revolution or after a different fraction of revolution of the unit 253, which is caused to rotate at a much slower speed than that at which the working cycles of the organs of the machine are driven.

In FIG. 20 there are indicated a few types of chains for which there are required different programmings with respect to the movement of the collecting tray 253, assuming that the longer link A is constructed in the right-hand section of the machine.

In particular, for instance, for the chain indicated by M1 it is necessary to provide a rotation of the tray in counterclockwise direction in the section indicated by Ca of the formation of the chain, while for the section Cb, corresponding to the construction of a single link in the left-hand section, the tray must remain stationary. In the chain indicated as M2, the tray must rotate in counterclockwise direction in section Ca and in clockwise direction in the section indicated by Cb. In the chain indicated as M3, the tray must be inoperative. In general, when links are produced with a ratio of 1:1, the tray must remain stationary; when links of a different ratio are produced (in such a manner that the construction of a single link is programmed on neither of the two sections of the machine), the tray must start to turn, after the first link has been constructed, in counterclockwise direction driven by one of the clutches when the machine works on the right-hand section and in clockwise direction, after having constructed the first link, actuated by the other clutch; when links are produced with such a ratio that in one of the two sections a single link is constructed, the tray must remain stationary when that section of the machine works, while it must rotate when the section which produces several links is working. Furthermore, the tray must remain stationary during the translation of the group of the shaping tools from one position to the other position.

In each case, the programming of the control of the tray is established as a function of the operating program of the machine for the production of the individual chains and as a function of the necessity of uniform accumulation with respect to what is effected by the machine.

The machine comprises a certain number of drives with electric switch; some of the more important ones are indicated below and shown in the drawing.

Figure 21:
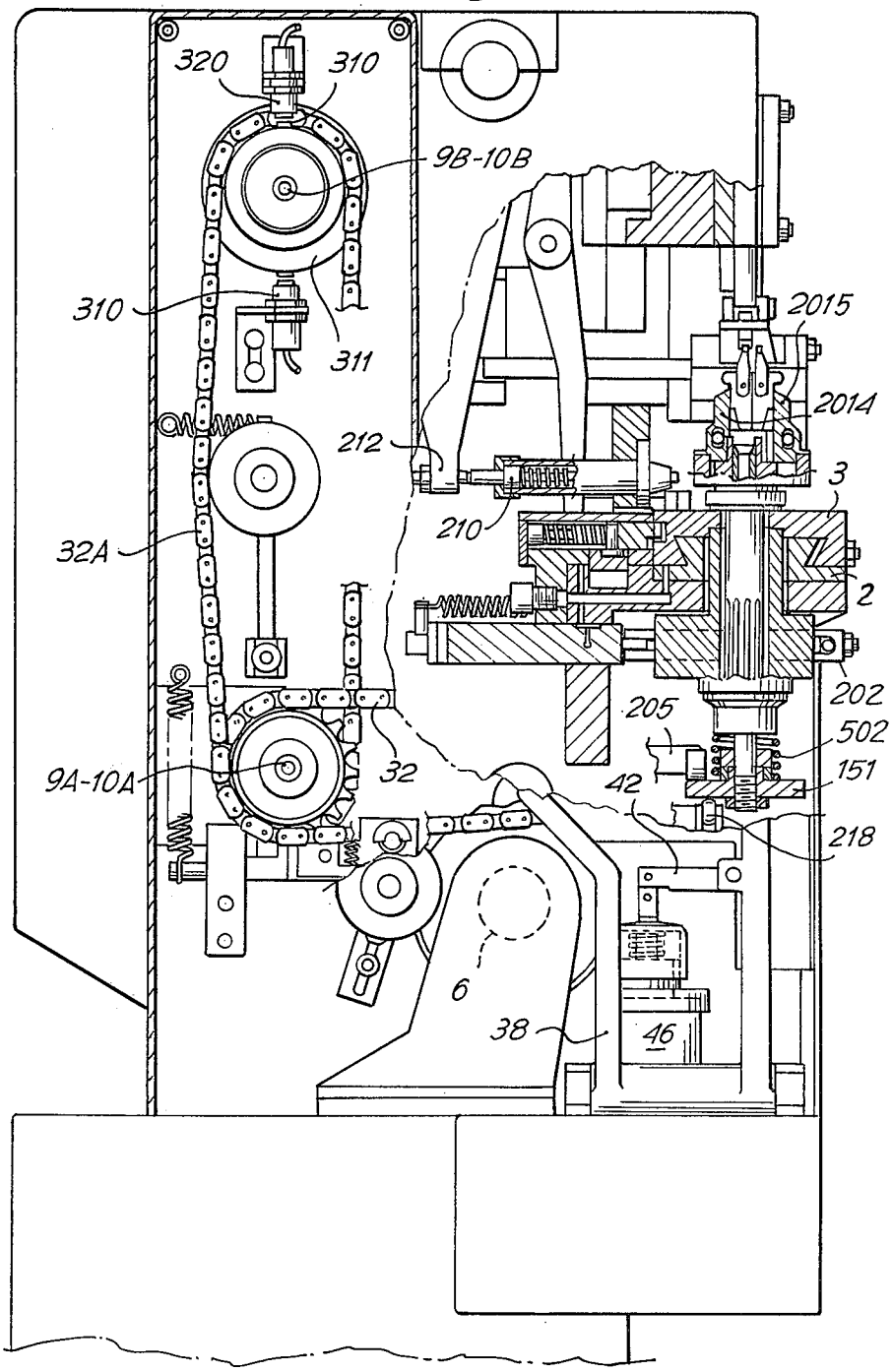
FIG. 21 is a side view from the left side of the machine equipped for "venetian", in section along the line XXI—XXI of FIG. 1A.
Figure 22:
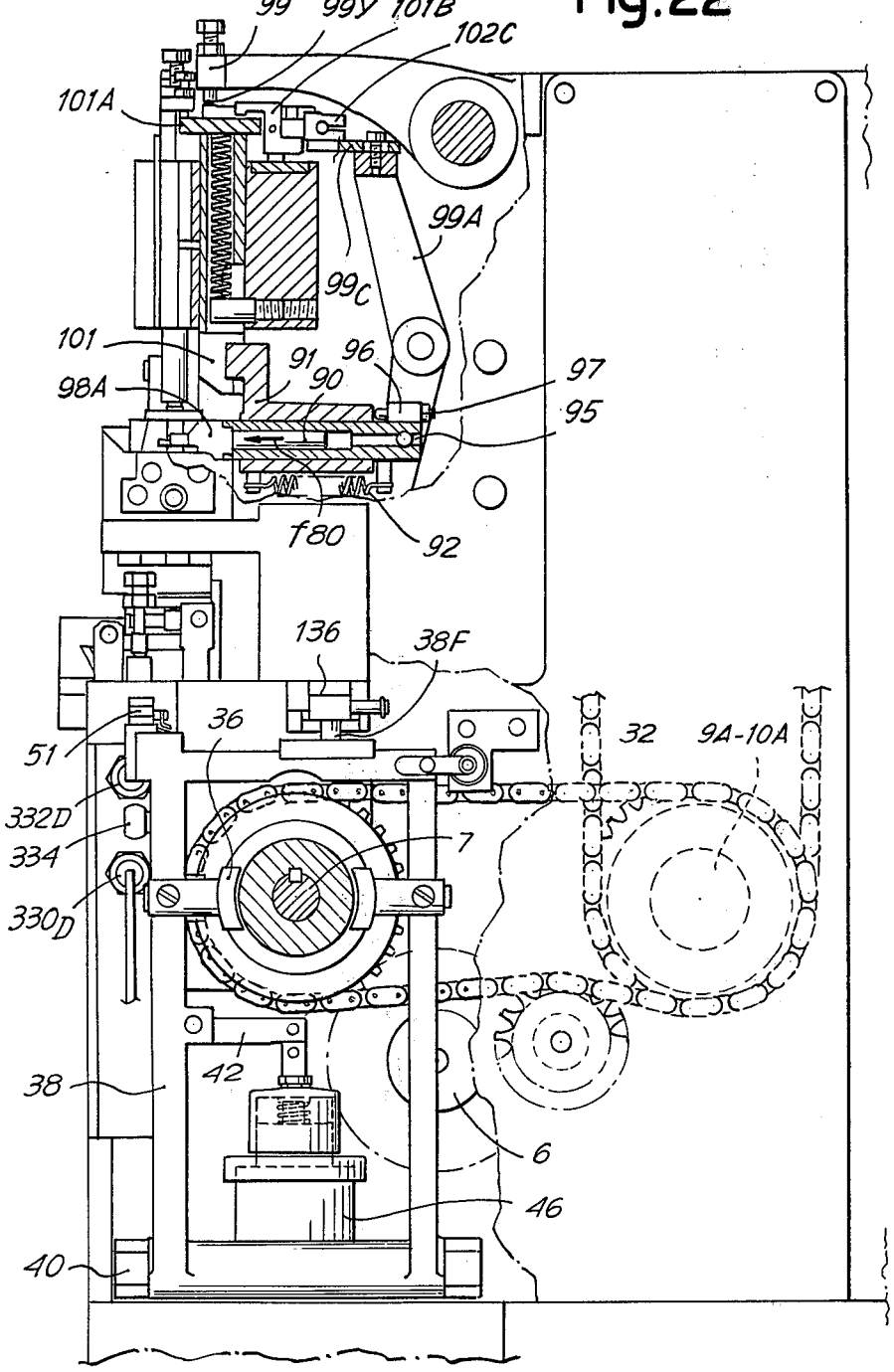
FIG. 22 is a side view from the right side of the "venetian" machine in a section along the line XXII—XXII of FIG. 1A.

By 310 (see FIG. 21) there is indicated a revolution-counting switch which therefore counts the links formed by a pair of half shafts of alternating motion; said switch is driven by a pin borne by the periphery of the disk 311; on the other hand, similar elements, not shown in the drawing, are provided. Alongside the disk 311 there is provided another drive profile 314 which acts on a switch 320 which serves as block for the motor in case of difference in phase at the time of the stopping of the corresponding half shafts; similar components are provided on the other section of the machine. In combination with each of the forked levers 38 there is provided (see FIGS. 1A and 22), a series of switches 330S and 330D controlled by the sensors 331S and 331D and, respectively, a series of switches 332S and 332D controlled by the sensors 333S and 333D; the sensors 331 and 333 are actuated by stems 334 combined with the respective forked lever 38. Only the members 330D, 331D, 332D and 333D are visible.

Figure 23:
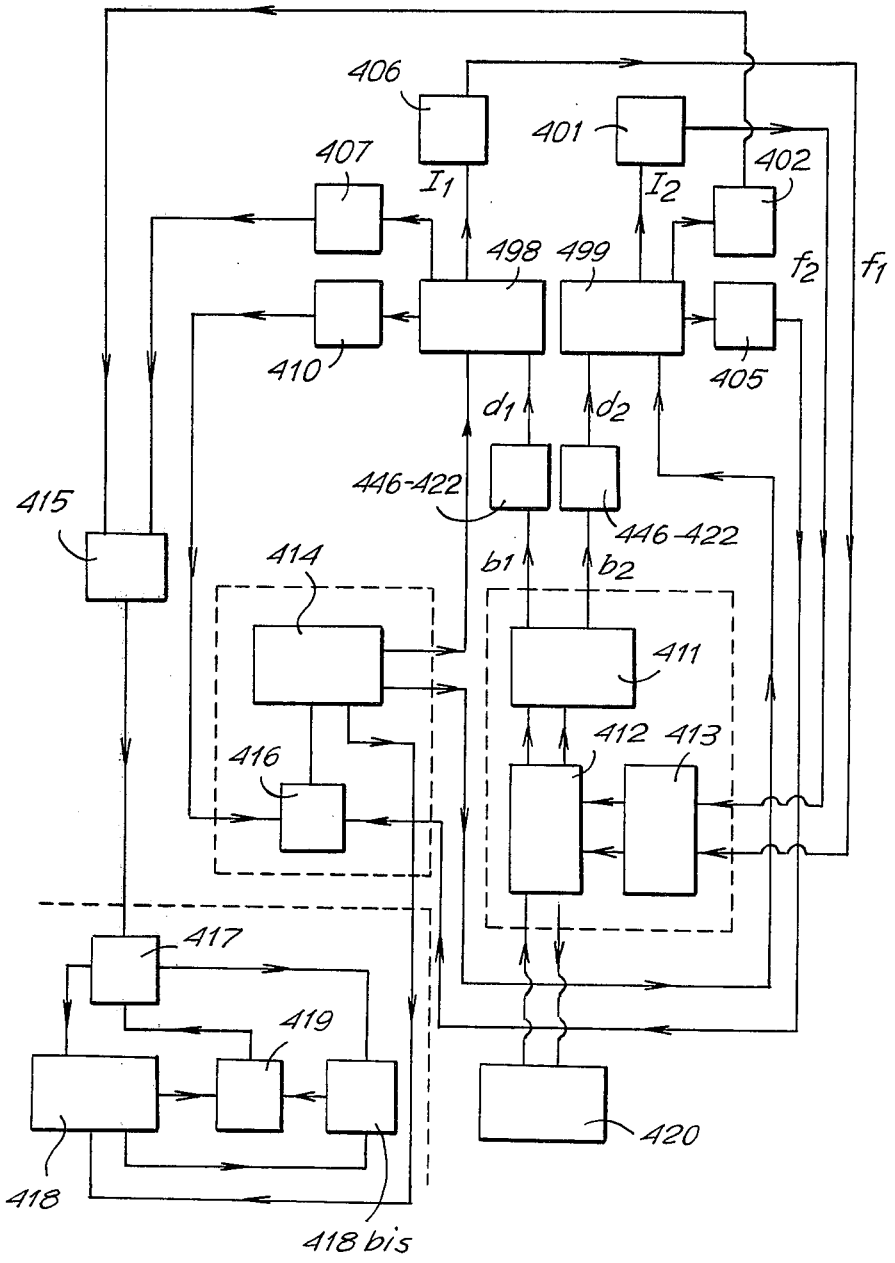
FIG. 23 is a block diagram of the carrying out of the program.

In FIG. 23, there is shown a block diagram for the carrying out of the program.

412 is an electronic programmer, 411 a pulse generator; 446–422 two pre-setting members for the carrying out of the program, they corresponding in practice to the electromagnets 46 and 13 on the two sides of the machine. 498 diagrammatically indicates the detection members 330S and 332S and the corresponding forked lever (executor) 38 of the left-hand part of the machine, as well as the possible members which send the signal to the electromagnet 500 (FIG. 12), and 410 is the presetting control member, in practice the switch 330S of the respective executor.

499 diagrammatically indicates the detection members 330D and 332D and the corresponding forked lever 38 (performer), as well as the possible detectors which control the magnet 500 for the right-hand part of the machine, and 405 is the respective pre-setting control member, in actual practice the switch 330D, of the executor on the right-hand side. 401 and 406 are the revolution detectors (in practice the members 310, 311 of FIG. 21), the data of which are supplied to the program control 413 and to the brake-clutch group 282, 265A, 265B (FIG. 19). 407 and 402 are signal detectors represented by the two right and left switches 320, the drives of which are coordinated with the block 418—418 bis formed of the brake-clutch. 414 is a drive block, and 416 the control member of the block. A detector 417 and position control 419 for the tray 253 are represented by the switch 271 (FIG. 19), and by the pins 273. When the unit referred to in the above-described block diagram is preset for a variable program with memory, a memory 420 of the magnetic memory type or with tape or strip reader or the like can be coordinated with the programmer 412.

The operation of the foregoing is substantially as follows.

Figure 1A:
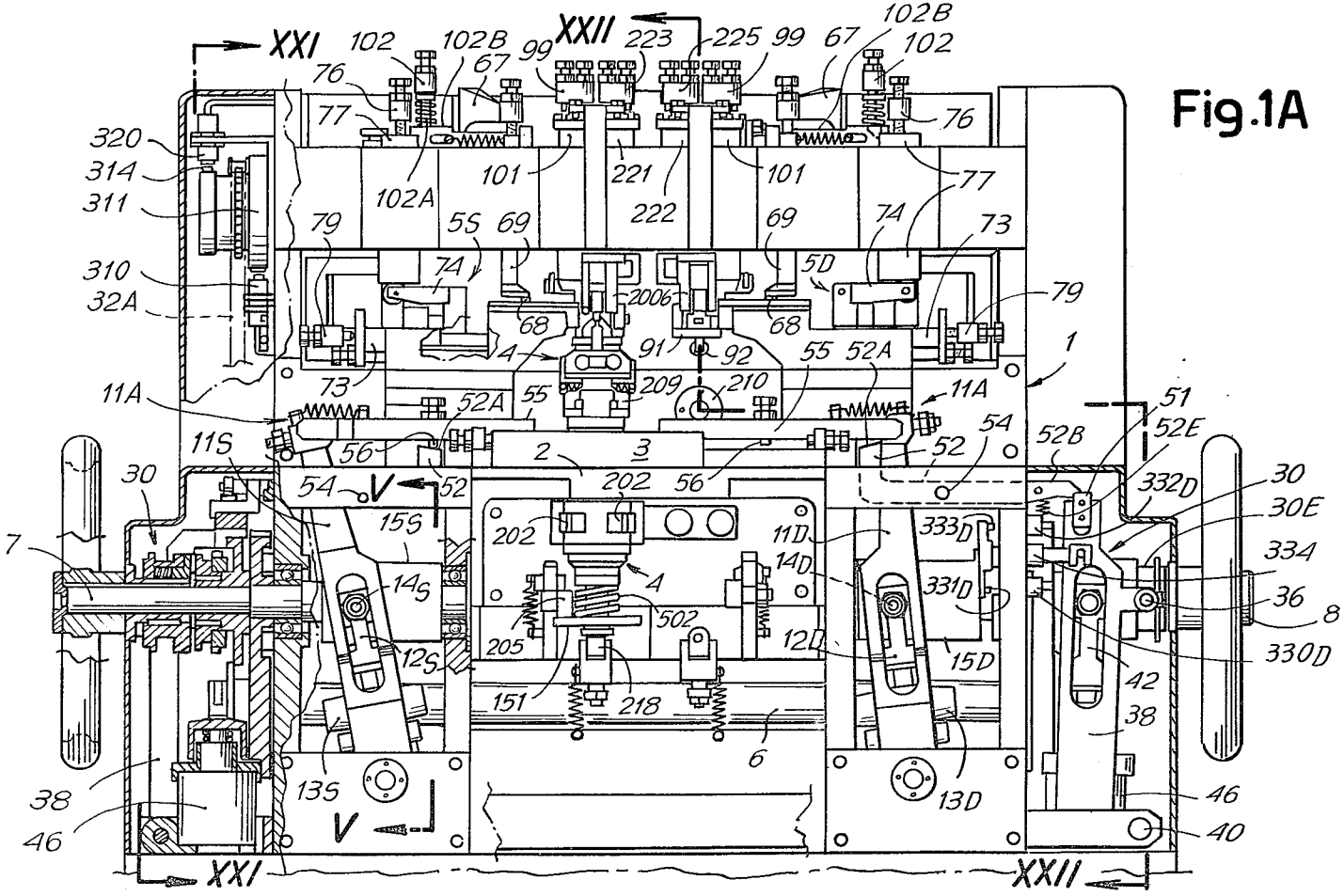
FIG. 1A is a similar front view of the machine, equipped to form a chain with square links ("venetian" machine)
Figure 9:
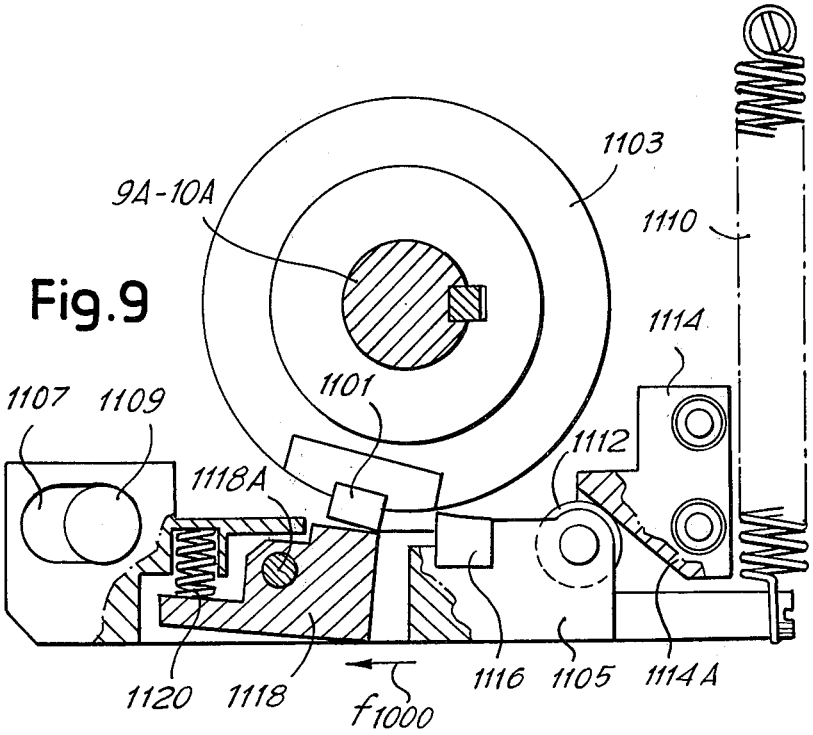
FIG. 9 shows a detail of a device for blocking in angular position half-shafts imparted alternating and therefore intermittent motion.

Via the data of the stroke counters, namely of the blocks 401 and 406 cooperating with the programmer, the machine is instructed to carry out the program of alternations desired. Let us examine the electronic operation commencing with the start of the cycle in the right-hand part of the machine. Each revolution of the half shafts 10B and 10A of alternating motion is signalled via the protruding pin of the disk 311 (FIGS. 1A and 21), which comes to touch the proximity switch 310, namely the right-hand revolution detector 401. Upon the completion of the last revolution of the program established, detected by the control 413, the unit 412 and 411 transmits a signal to the right outer magnet 46 which, becoming energized, causes an angular displacement of the corresponding bell crank lever 42, bringing the roller 48, placed at the upper end of the said lever, into working position. The cam 50 coming into contact with the roller 48 causes the angular displacement of the oscillating lever or fork 38 via which the disengagement of the half shafts 10B and 10A in question takes place. The oscillating lever 38 is compelled to remain in the position of disengagement from the retaining system formed of the members 52, 52B, 51 already described. The stopping of the half shafts 10 and 10A in the pre-established position is facilitated by the stop group comprising the small lever 1105 (FIG. 9). In the displacment, the oscillating fork lever 38 carries along the element 334, so that the sensors 331 approach the proximity switches 332D (FIG. 1A). At the same instant (the half shafts 10B and 10A also being stopped), the pin 314 is positioned in correspondence with the right-hand proximity switch 320. By means of the switches 320 and 320D the part of the circuit which involves the energizing of the right-hand magnet 13D which controls the translation, becomes entirely closed. The magnet 13D, upon becoming energized, causes the angular displacement of the bell crank lever 12, bringing the roller 14 mounted on its upper end into contact with the continuously rotating translation cam 15, which causes the displacement of the lever 11. The lever 11 is engaged with the slide 3 of the shaping tool group 4, which is thus translated into the left-hand working position (opposite the previous position). The translation having been effected, the left-hand oscillating lever 38 is disengaged by the combined action of the members 51, 52, 52B, 55, 56 in order to cause the half shafts 9A and 9B to start with the clutch 30.

The left-hand lever 38, upon its displacement, in addition to engaging the mechanism 30 (FIGS. 6, 7 and 8), which controls the engagement of the corresponding half shafts 9A and 9B, pushes the left-hand member 335 which bears the left-hand sensors 331 and 333 (FIG. 1A) in order to remove the signals from the right-hand switches 330, 332 which de-energize the right-hand magnet 13, disengaging from the cam 15 the drive unit comprising the arm 11. It may happen that the translation does not take place completely, for which reason there enter into action one or the other of the right-hand or left-hand proximity switches 320 (depending on whether the translation is towards the right or toward the left), which are not touched by the corresponding sensor 331, since the lever 38 is not disengaged, so that they automatically block the motor.

As already described, the machine is suitable for the manufacture of chains with several combinations and in order to prevent the chain becoming entangled as it falls into the collector, there is provided the device—already described—for the advancing or non-advancing of the collection container 253. Due to the fact that the shaping tool holder head can rotate both in clockwise direction and in counterclockwise direction (depending upon whether is it working on the left or on the right of the machine), the collecting group also must be given the possibility of rotating in the above-mentioned directions and of seeing to it that it remains stopped both during the translation of the shaping tool group and during the first revolution of the cam half-shafts with alternating, namely intermittent, motion. The rotation of the collector is controlled by the right-hand and left-hand electromagnetic clutch groups which receive the pulses from the proximity switches 401 and 406, respectively (revolution detectors), which participate in the carrying out of the program of the machine.

The operation, with respect to the electronic part, takes place as follows, commencing from when the right-hand cycle is interrupted. The shaping tool group 4 effects the translation and initiates the cycle on the left-hand section. When the half-shafts 9A and 9B stop at the end of the cycle, the disk which bears the pin 314 thus finds itself in contact with the proximity switch 320, which in addition to permitting the energizing of the magnet 13 gives off a signal which, combined with the signal of the evolution detector 416, arrives at the proximity switch 271. The control to the electromagnetic brake to stop the rotation of the collector is completed when one of the pins 273, integral with the bevel gearing 257, passes in front of the proximity switch 271.

At the end of the translation, the cycle opposite the one previously effected is commenced and the revolution detector 401, upon completion of the first revolution of the cam half shafts, switches the signal from the brake to the clutch 282, and the tray 253 starts to rotate in clockwise direction.

At the end of the cycle, the combination of signals between the proximity switch 401, namely 310 and the proximity switch 271 (completed when one of the pins 273 is in front of it), will switch the drive from the clutch 282 to the corresponding brake.

The operation, with reference to the block diagram (FIG. 23) is as follows:

There is established, for instance, a program—with counters alone and without memory—which provides for the formation of three left-hand links and two right-hand links, namely there is established a "3Y and 2X" program. The numbers having been entered in the programmer 412, the machine is started with the device of the block 414. The number entered on the right-hand part (namely, 2) is changed into a drive pulse $I_2$ in the generator 411. This pulse is transferred by the connection $b_2$ to the pre-setter 446–422 which, via the connection $d_2$, permits the program executor (represented by the entire right-hand part of the machine, indicated in the diagram as 499) to start and complete a cycle, being controlled by the motor block 414. When the cycle is completed, the detector 310 (block 401) influenced in accordance with $I_2$, transmits to the program control block 413 via the connection $f_2$, a signal which is added to any others which have been previously received (one per link), and is compared with the number entered in the corresponding part of the programmer (412). The cycle is repeated until the execution member 499 has completed as many cycles as have been established for it or, better, its detection member 401 (the switch 310) has detected as many pulses as, added in the program control 412, give a number equal to the number entered. Still, through the generator 411, the program controls the left-hand part via the connection $b_1$; the left pre-setting member 446–422 is caused via $b_1$ to see to it that the program execution member 498 (left-hand part of the machine) via the connection $d_1$ starts to operate controlled by the block 414. In this case, the detector 406, influenced in accordance with $I_1$ via the connection $f_1$, will send to the program control 413 the pulses which will be added to and compared with those entered in the corresponding part of the programmer 412. The other cycles are then continued.

If the machine does not have its own execution members duly phased, this will be detected by the presetting control member 410 and 405, represented by the switches 320, which act on the control member of the block 416, which stops the motor block 414.

The machine is preset to carry out—with the possibility still of producing chains with two different shapes and dimensions—a combination of alternations greater than the two previously described.

Let us assume that it is desired to carry out a cycle which is established as follows: 1Y-2X; 1Y-3X; 2Y-4X. On the part of the programmer 412 which controls the right-hand arm of the machine, there are inserted three presetters on which there are entered the digits 1, 1, 2, while in the left-hand portion of the programmer 412 there are inserted three presetters in which there are entered the digits 2, 3, 4. Without changing the concept of operation of the blocks, the presetters will alternate with each other as follows:

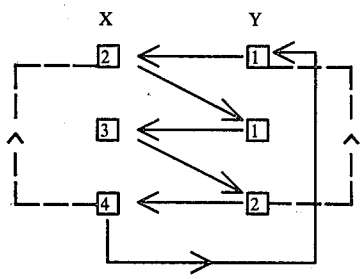

If it is desired to carry out even more complicated cycles, the presetters of part X and of part Y can be replaced by two pulse receivers (one per part) and upstream of the programmer 412 there is provided the "memory" block 420, in correlation with the said programmer, so as to be able to insert variable and repeatable programs (equivalent, in the preceding system, to the numbers indicated in the presetters). In order to achieve this, any program which it is desired to carry out is memorized, by magnetic support or tape or strip reader, for instance: Y3-X2; Y1-X4; or another, namely with any number of pairs of values X and Y (left and right). This program being entered in the memory block 420, the first two values of X and Y (in this case Y3-X2) are transmitted to the programmer 412. At this point, the machine is started, it following the part of the program relative to Y3 in the manner described previously. The execution of the part of the program relative to Y3 having been completed, the programmer 412 transmits to the memory 420 the information as to the program carried out (this while the machine is carrying out the program, for instance, according to X2, relating to the left-hand part). The memory in the meantime, replaces the Y3 by Y1 in the programmer so as to preset the logic of the circuit for the execution of the following left program. This interchange of information takes place until the end of the combinations entered in the memory; the cycle at this point will be repeated again in the sequences Y3-X2; Y1-X4, and so on.

As described previously, as soon as the machine has carried out the part of the program relating to the last value of Y entered, the memory replaces this value by the first value entered by Y (in this case Y=3).

In the production of a chain of the "venetian" type, indicated by V in FIG. 20, the links can be slotted in order to create links which are apparently doubled and spaced. This can be obtained by feeding a cut strip and possible providing a centering wedge before the pressing down of the tape stop, an end stop cooperating herewith or being substituted. As an alternative, the cutting of the slots can take place directly on the machine, in a position close to the link-forming tools, for instance at the place of the member 68 (FIG. 1A).

It is understood that the drawing shows merely an example given solely as a practical demonstration of the invention, and that the invention can be varied in its forms and arrangements without thereby going beyond the scope of the concept upon which it is based.

What is claimed is:

1. A machine for the manufacture of chains comprising:

first and second substantially symmetrical machine sections, each of said first and second machine sections including means for operating upon the chain to be formed;

a slide bearing a rotating unit having pincer tools for engaging the links of the chain to be formed, said slide being constructed and arranged to be displaceable between first and second working positions corresponding to said first and second machine sections;

means for displacing said slide;

first and second continuously rotating camshafts corresponding to said first and second machine sections;

tappet means selectively engageable between said means for displacing said slide and said continuously rotating camshafts for transmitting the motion of said camshafts to said displacing means to thereby displace said slide;

locking means to lock said slide at said first and said second positions; and at least third and fourth camshafts correponding to said first and second machine sections, engagement means engaging between said first and second continuously rotating camshafts and said third and fourth camshafts, respectively, to alternately operate said third and fourth camshafts to thereby alternately actuate said chain operating means in said first and second machine sections.

2. A machine according to claim 1, further including diametrically slidable head means mounted on said rotating unit, first and second diametrically opposed pincer tools mounted to said head means, means for displacing said head diametrically so that said first pincer tool which has transferred the link of the chain to be formed is displaced towards the outside of said rotating unit and to place said second pincer tool into engagement with the subsequent link of the chain to be formed.

3. A machine according to claim 1, wherein said rotating unit is driven so that it rotates in a first direction in said first working position and rotates in a second direction, opposite said first direction, when said slide is in said second working position.

4. A machine according to claim 1, further including container means for receiving the chain formed at either of said first or second working positions of the slide, said container means including means for imparting rotating motion thereto, said rotating motion being syncronized with the link-forming cycle, said container means being rotated in alternate directions as a function of the position of said slide, said container rotating means including clutch means, said clutch means being controlled for engagement afer the formation of a link in either of said first or second working positions, and a stop switch controlled by the movement of said container means acting to stop said container means from rotating.

5. A machine according to claim 1, wherein said means for operating upon the chain include anvil tools, said anvil tools being lowered into engagement with the link to be formed so that said link is closed at the bottom thereof, said anvil tools include first and second independent stroke registers, means for activating said stroke registers, said first stroke register being activated during the closing of the first link formed after the displacement of said slide, the second stroke register being activated during the closing of the subsequent links.

6. A machine according to claim 5, wherein said stroke register activating means are activated alternatively by the displacement of block means disposed below either of said first or said second registers.

7. The machine according to claim 5, further including slot cutting means, said slot cutting means acting upon the links of said chain to cut a slot therein to provide a chain having the appearance of doubled, spaced links.

8. The machine according to claim 1, wherein said means for displacing said slide comprise first and second control levers coupled to said slide, said tappet means being mounted to activating levers, electromagnetic means for displacing said activating levers and said taper means into engagement with said first and said second continuously rotating camshafts.

* * * * *